US006283546B1

(12) United States Patent
Hill

(10) Patent No.: US 6,283,546 B1
(45) Date of Patent: Sep. 4, 2001

(54) MULTI-POSITION CHAIR

(75) Inventor: Peter C. Hill, Plano, TX (US)

(73) Assignee: Spang & Company, Butler, PA (US)

( * ) Notice: Subject to any disclaimer, the term of this patent is extended or adjusted under 35 U.S.C. 154(b) by 0 days.

(21) Appl. No.: 09/245,321

(22) Filed: Feb. 5, 1999

(51) Int. Cl.[7] ..... A47C 3/02

(52) U.S. Cl. ..... 297/271.1; 297/130; 297/188.1; 297/423.26; 297/260.3

(58) Field of Search ..... 297/423.2, 130, 297/131, 271.1, 271.2, 271.3, 271.4, 271.5, 118, 188.08, 188.1, 423.26, 260.3, 423.28, 423

(56) References Cited

U.S. PATENT DOCUMENTS

| | | | | |
|---|---|---|---|---|
| D. 260,823 | | 9/1981 | Stulik, Jr. . | |
| D. 334,487 | | 4/1993 | Perry . | |
| 3,469,882 | * | 9/1969 | Larsen | 297/118 |
| 4,160,564 | | 7/1979 | Kyle . | |
| 4,461,470 | | 7/1984 | Astroth et al. . | |
| 5,054,771 | | 10/1991 | Mansfield . | |
| 5,110,183 | | 5/1992 | Jeanes, III . | |
| 5,195,746 | | 3/1993 | Boyd et al. . | |
| 5,290,034 | | 3/1994 | Hineman . | |
| 5,419,613 | | 5/1995 | Wedeking . | |
| 5,423,592 | | 6/1995 | Spurrier et al. . | |
| 5,437,453 | | 8/1995 | Hineman . | |
| 5,547,256 | | 8/1996 | D'Antuono et al. . | |
| 5,681,082 | | 10/1997 | Drexler . | |

* cited by examiner

*Primary Examiner*—Anthony D. Barfield
(74) *Attorney, Agent, or Firm*—Kirkpatrick & Lockhart LLP

(57) ABSTRACT

A multi-postion chair. The chair includes a base that has a seat and a seatback attached thereto. The seatback may be reclined relative to the base in a plurality of positions. An arcuate foot rest is pivotally attached to the base such that it may be pivoted under the base to enable the chair to be rocked thereon. In the alternative, the footrest may be extended relative to the base to provide a footrest for the occupant. A storage well may be provided in the base and the seat may be pivotally attached to the base such that it overlies the storage well. The chair may have pivotable armrests attached to the base and an adjustable headrest attached to the seatback.

47 Claims, 23 Drawing Sheets

MULTI-POSITION CHAIR

CROSS-REFERENCE TO RELATED APPLICATIONS

Not applicable.

FEDERALLY SPONSORED RESEARCH

Not applicable.

BACKGROUND OF THE INVENTION

1. FIELD OF THE INVENTION

This invention relates to chairs, and in particular, to chairs that can assume multiple orientations and which may be advantageously used when playing video games.

2. DESCRIPTION OF THE INVENTION BACKGROUND

Home video games enjoy great popularity in today's society. As the capabilities of microcomputer programs continue to grow at astonishing rates, the graphics and audio of today's video games have become more life-like and, in some cases, intense. As a result, to enhance the game playing experience, there have been many efforts to provide accessories for use with such games.

Specifically, video game accessories in the form of chair apparatuses have been developed. For example, U.S. Pat. No. 5,290,034 and U.S. Pat. No. 5,437, 453 to Hineman ("Hineman") disclose an adjustable height game chair with footrests and an integral joystick.

U.S. Pat. No. 5,419,613 to Wedeking ("Wedeking") discloses a platform connected to a chair on which a video game controller is secured. In Wedeking, an elongated structure connects to the platform at one end and connects to the chair by way of a base at the other end. Wedeking discloses a "leg-less rocker" to which the platform of the invention is affixed. The chair is legless, consisting simply of a seat and backrest.

U.S. Pat. No. 5,195,746 to Boyd et al. ("Boyd") discloses an aircraft simulator that includes a movable seat facing a video display. The seat disclosed in Boyd can be tilted about a central socket that connects the seat to a base and includes a control that causes the image on the video display to shift in response to the tilting movement of the seat.

U.S. Pat. No. 5,054,771 to Mansfield ("Mansfield") also discloses a computer interactive game machine with a swinging seat. Mansfield also discloses an integral video display monitor. Here, the machine includes a support structure, a seat mounted on the support structure and swingable along two axes, a handle bar mounted on the support structure in front of the seat for pivoting the seat about the two axes, and a position sensor responsive to movement of the seat. Mansfield also discloses feet stirrups that affect movement of the seat.

U.S. Pat. No. 4,461,470 to Astroth et al. ("Astroth") discloses a system for adding realism to a video display by moving a seated player and a video screen to correspond to a scene displayed on the video screen. Astroth discloses a stationary base unit and a platform supporting a chair and a console containing a video screen. The platform is simultaneously tiltable both front to back and side to side. Astroth also discloses a programming means that causes various views to be displayed on the screen, a drive means that causes the platform to tilt and a control means that causes the programming means and drive means to act in cooperation with one another.

U.S. Pat. No. Des. 334,487 to Perry ("Perry") also discloses a video game control seat. The Perry seat has a conical base that supports a single-piece seat and backrest in a fixed position. The seat and backrest are flared to extend partially around the occupant.

U.S. Pat. No. Des. 260,823 to Stulik, Jr. ("Stulik") discloses a game chair. The Stulik chair is rectangular in shape, having a base, a seat, a backrest, and two arms. The base is a solid rectangle that rests on a floor surface and supports the chair. The arms each have an upper surface with depressions and the right arm has an extension portion protruding beyond the front of the chair.

A video game accessory chair manufactured under the name The Virtual Vehicle JD, by Interactive I/O Inc., includes a frame supporting an adjustable seat, gas and brake pedals, and a monitor stand from which projects a steering wheel. The frame comprises two side rails, and an axle having a wheel on either end extends between the front portion of the sidewalls. The gas and brake pedals are disposed on a pedal support bar that extends between the sidewalls behind the axle. The seat is disposed on a pedal platform that is movably disposed on the side rails. Two substantially vertical rails support the monitor stand in front of the seat and a steering wheel projects out from the monitor stand toward the seat.

The Intensor, by BSG Labs, Inc., includes a seat and backrest that may be folded together, five integral speakers for connection to the audio jack of a gaming system, and an optional office chair base. When utilized without the office base, the base appears to be rockable.

While the aforementioned seats/chairs purport to improve and/or enhance the video game experience, they often sacrifice comfort.

Thus, there is a need for a video game accessory chair that can enhance the video game playing experience while providing a comfortable seat that can be advantageously adjusted to better support an occupant's body.

There is a further need for a video game chair that is convertible between a stationary chair and a rocking chair.

A need exists for a video game chair that can recline to a variety of different positions.

There is stall another need for chair that has a storage area for storing games, controllers, etc., when not in use.

Yet another need exists for a chair having the above-mentioned attributes that is comfortable and provides a leg rest, an adjustable head rest and rotating arm rests.

SUMMARY OF THE INVENTION

In accordance with preferred forms of the present invention, there is provided a chair that comprises a seat and a seatback that is attached to the seat. The chair further comprises a foot rest that is pivotally attached to the seat and that is pivotable between a first position wherein the foot rest forms a rocker base and a second extended position relative to the seat. The seat and the seatback may be attached to a base that has a storage well therein. The seatback may be selectively supportable in a plurality of reclined positions relative to the seat. The chair may further include arm rests that are detachably affixed to the base and rotatable relative to the base to enable the seat to be pivoted to an open position to gain access to the storage well in the base.

The subject invention also comprises a chair that includes a base that has a storage well formed therein and a seat that is pivotally attached to the base such that the seat may be selectively pivoted between a closed position wherein the seat overlays the storage well to define a storage area in the base and at least one open position wherein the storage well is exposed. The chair further includes a seatback that is pivotally attached to the base and selectively supportable in a plurality of non-planar positions relative to the seat. An adjustable headrest is attached to the seatback. The chair further includes at least one arm rest that is removably attached to the base and is selectively pivotable relative to the base. In addition, the chair includes a footrest that is pivotally attached to the base and that is selectively pivotable between a first position wherein the base is supported on the footrest and a second position wherein the footrest is extended relative to the base.

Accordingly, it is a feature of the present invention to provide a video game chair that enhances the video game playing experience.

It is another feature of the present invention to provide a video game chair that can be selectively and easily converted between a stationary chair and a rocking chair.

Another feature of the present invention is to provide a video game chair that can be selectively reclined to a plurality of positions.

Yet another feature of the present invention is to provide a video game chair that is equipped with an adjustable headrest so as to comfortably seat game players of various sizes.

It is also a feature of the present invention to provide a video game chair that is safe, comfortable and attractive.

A further feature of the present invention is to provide a chair having the above-mentioned attributes that is economical to manufacture and assemble.

Accordingly, the present invention provides solutions to the shortcomings of prior video game accessory chairs. Those of ordinary skill in the art will readily appreciate, however, that these and other details, features, and advantages will become further apparent as the following detailed description of the preferred embodiments proceeds.

BRIEF DESCRIPTION OF THE DRAWINGS

In the accompanying Figures, there are shown present preferred embodiments of the invention wherein like reference numerals are employed to designate like parts and wherein.

DETAILED DESCRIPTION OF THE PREFERRED EMBODIMENTS

Figure 1:
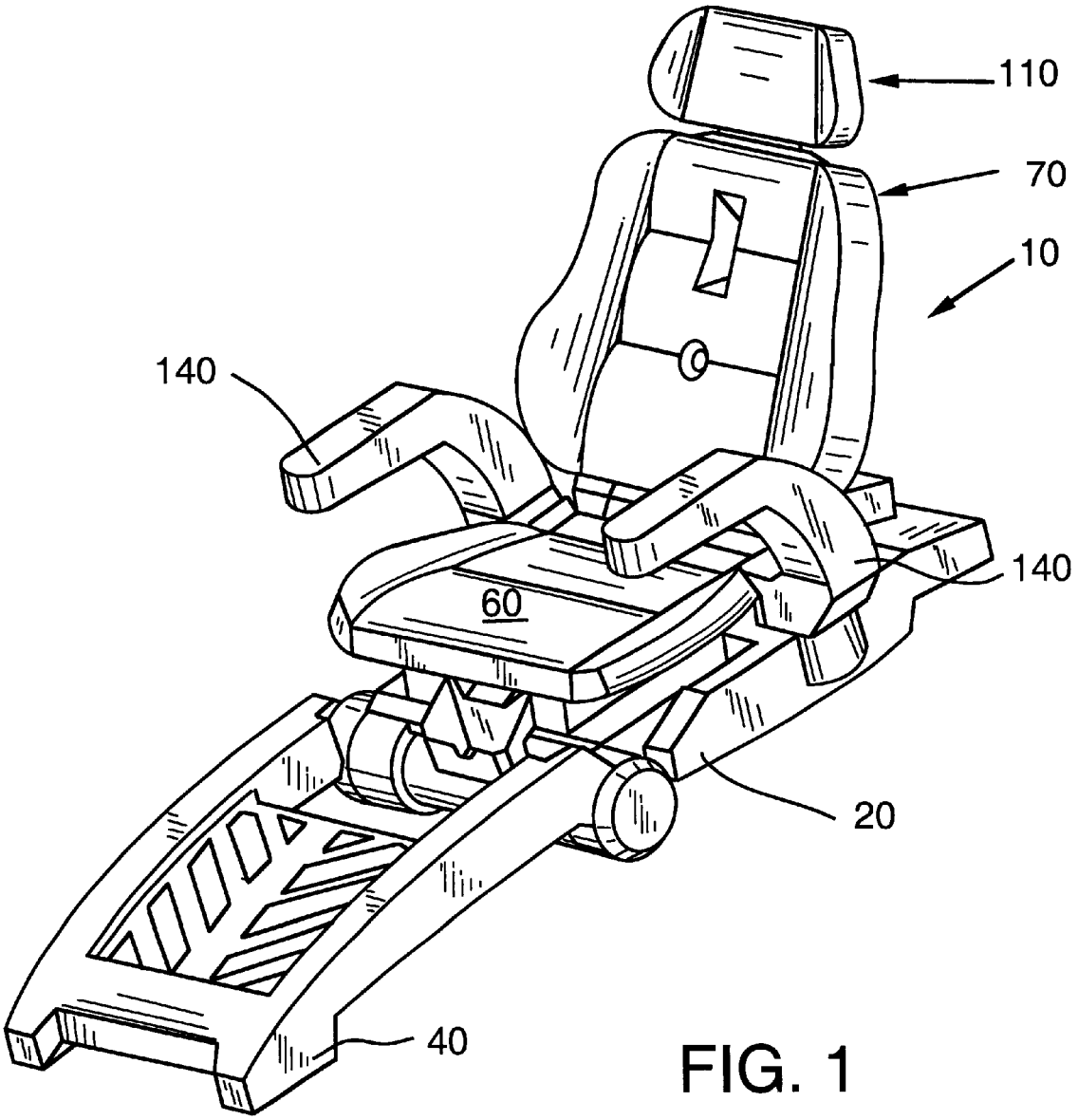
FIG. 1 is a perspective view of the chair of the present invention with the footrest portion thereof in an extended position.
Figure 3:
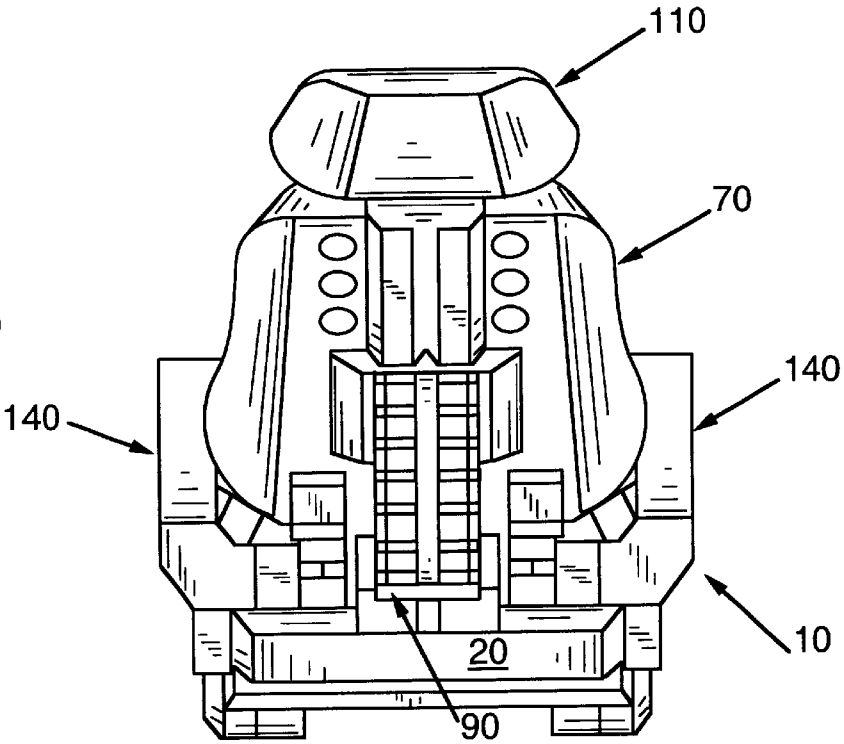
FIG. 3 is a rear view of the chair of FIGS. 1 and 2.
Figure 2:
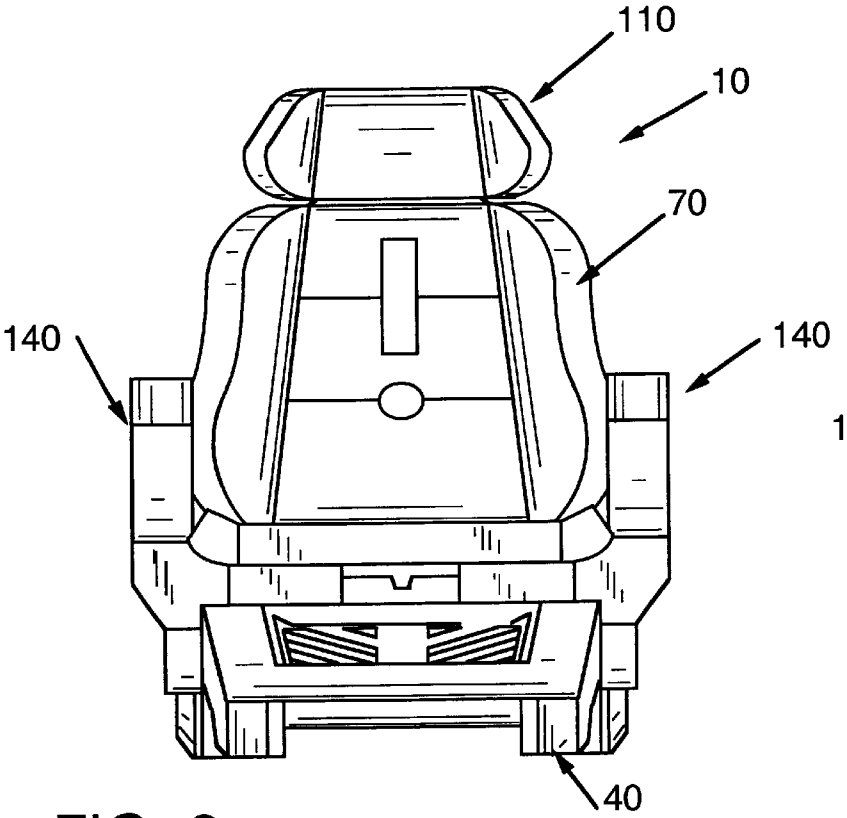
FIG. 2 is a front view of the chair of FIG. 1.
Figure 4:
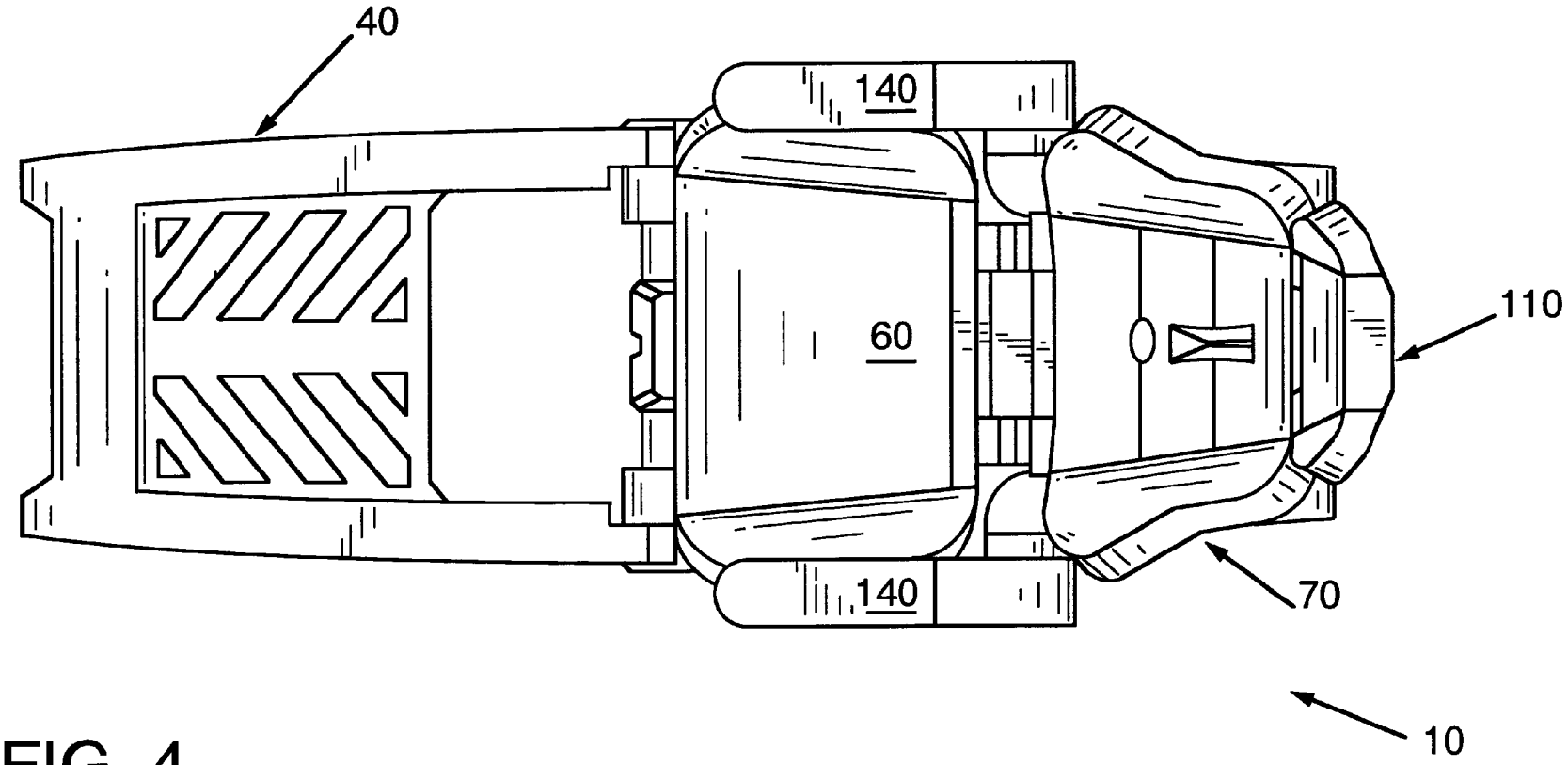
FIG. 4 is a top view of the chair of FIGS. 1–3.
Figure 5:
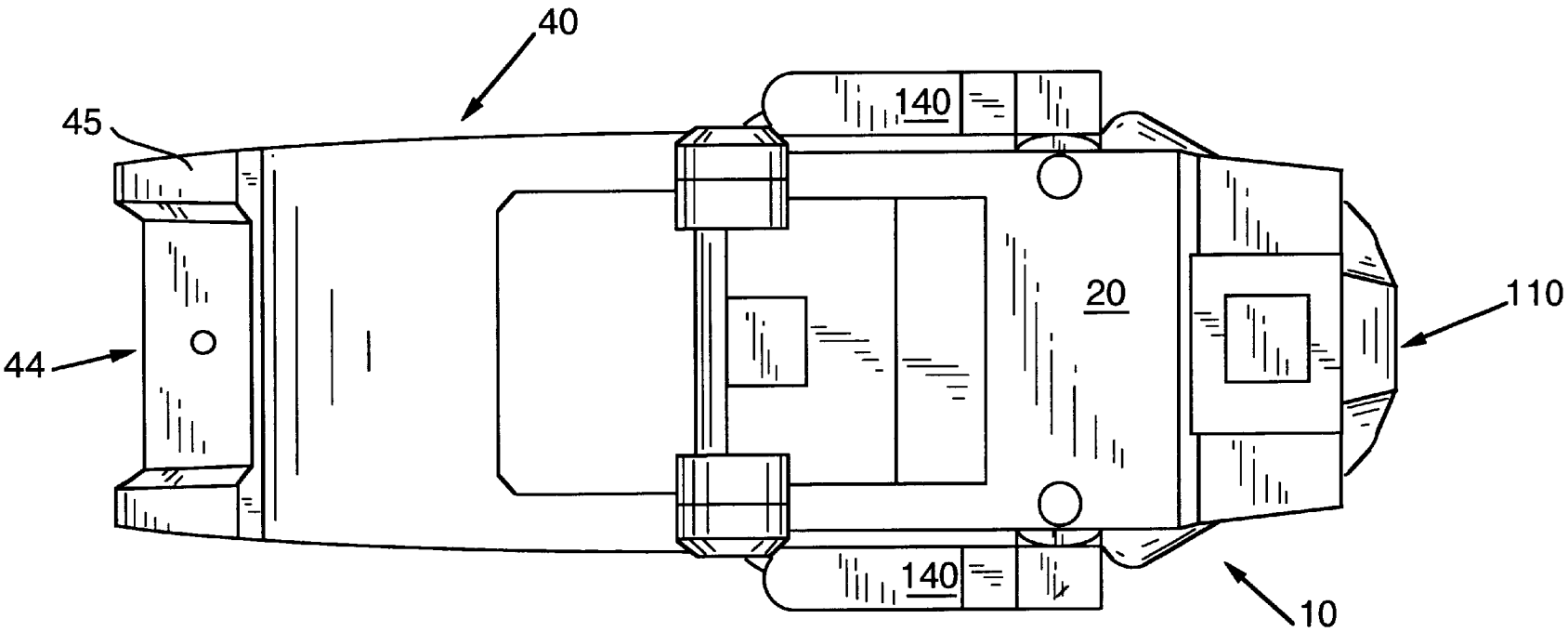
FIG. 5 is a bottom view of the chair of FIGS. 1–4.
Figure 6:
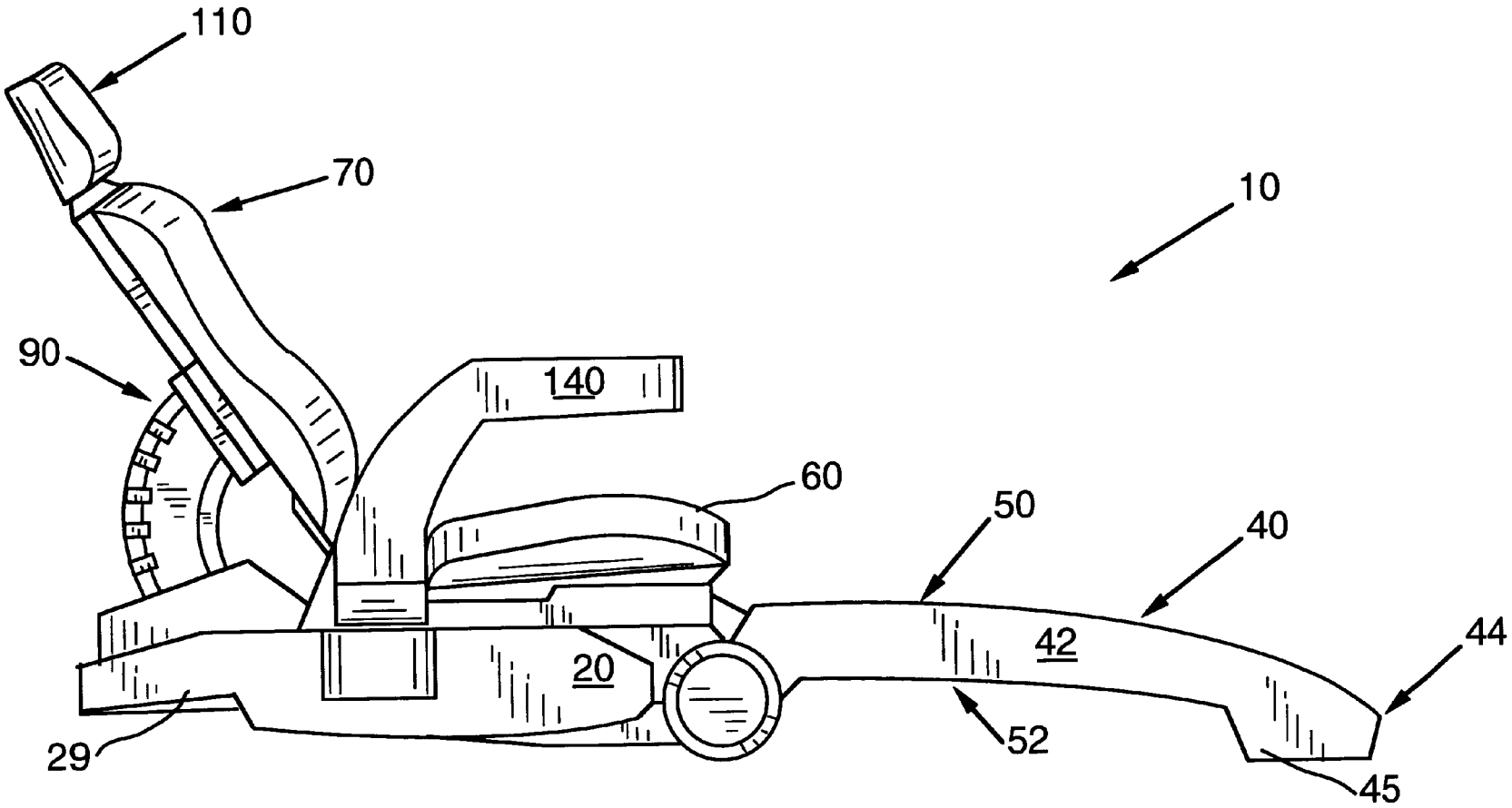
FIG. 6 is a right side elevation view of the chair of FIGS. 1–5.
Figure 7:
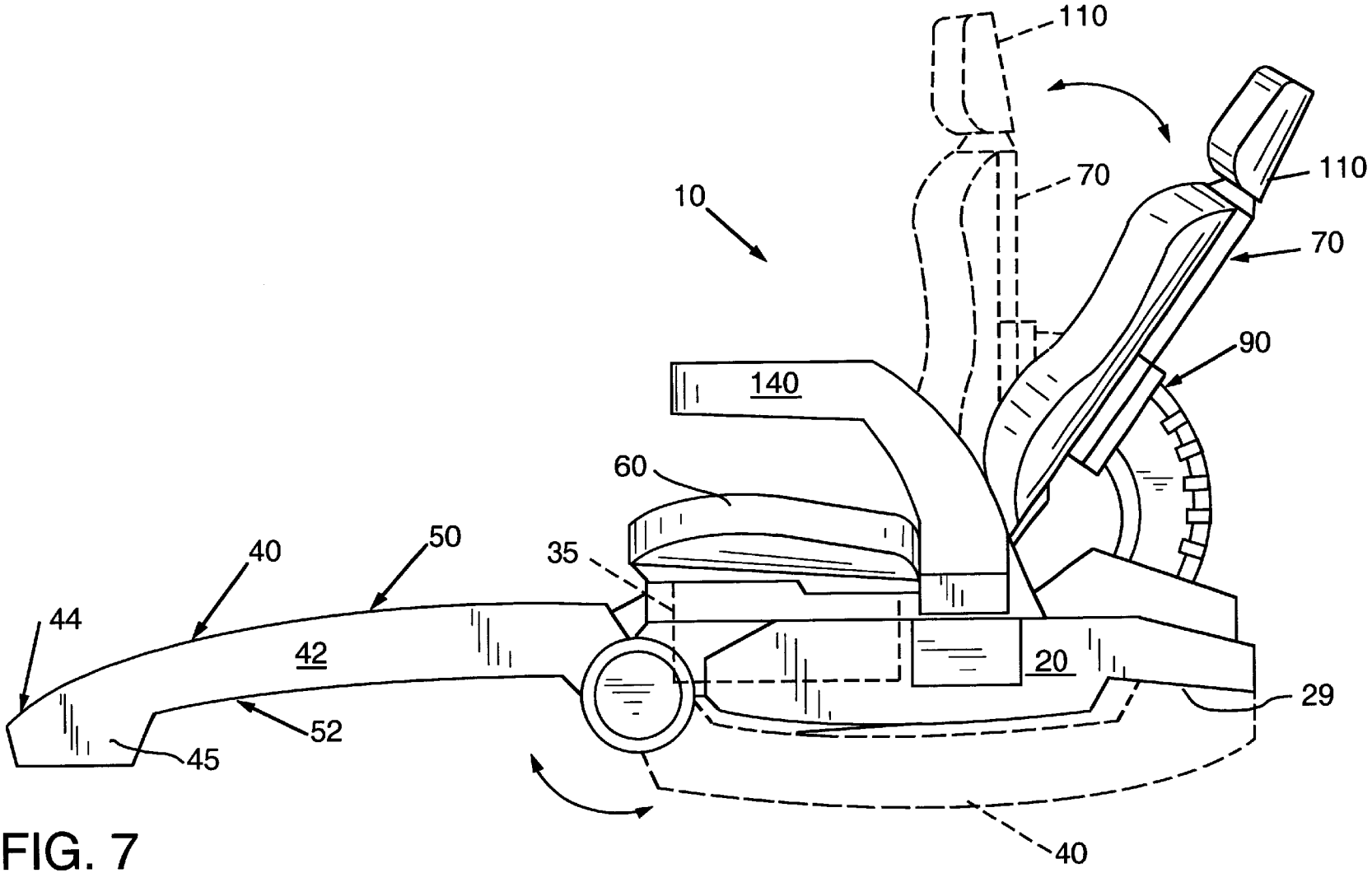
FIG. 7 is a left side elevational view of the chair of FIGS. 1–6 illustrating the pivotal travel capabilities of the seat an footrest of the chair of the present invention.
Figure 8:
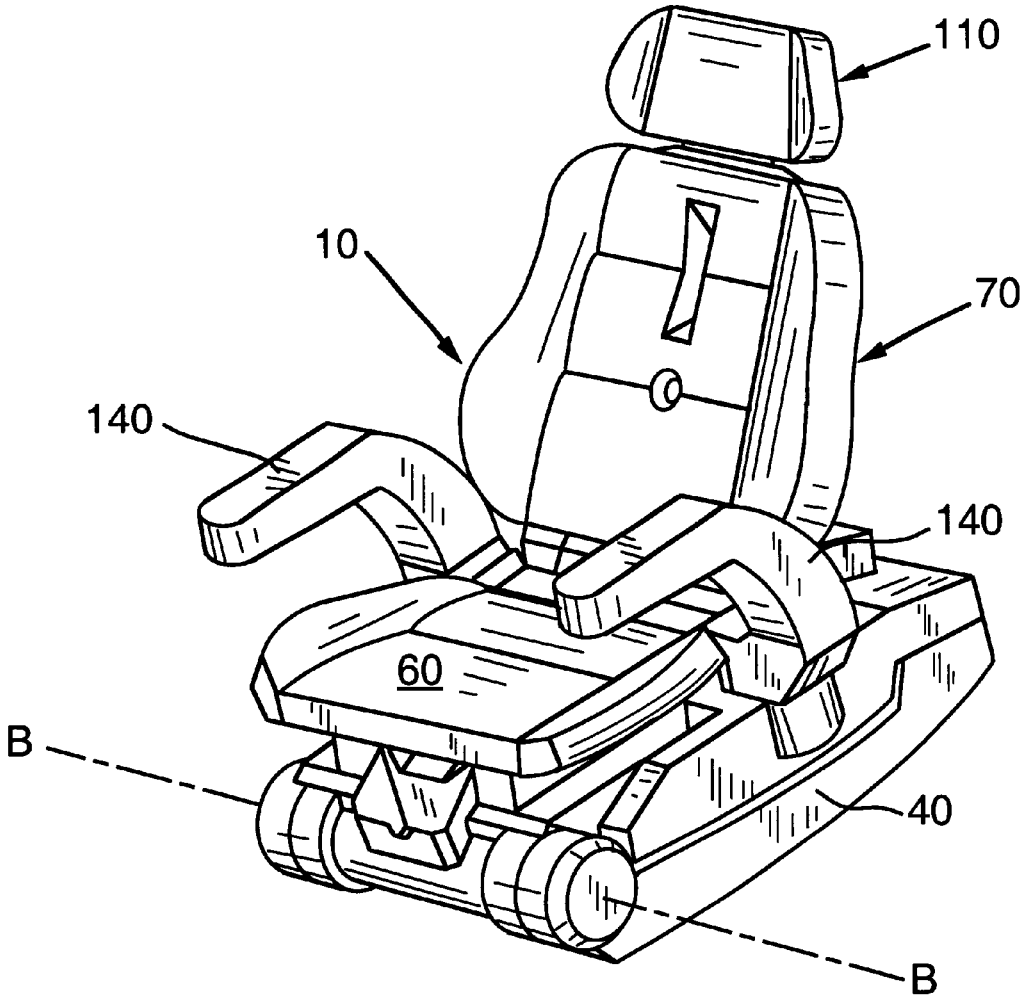
FIG. 8 is a perspective view of the chair of the present invention with the footrest portion thereof in a folded position wherein the footrest forms a rocker support for the chair.
Figure 10:
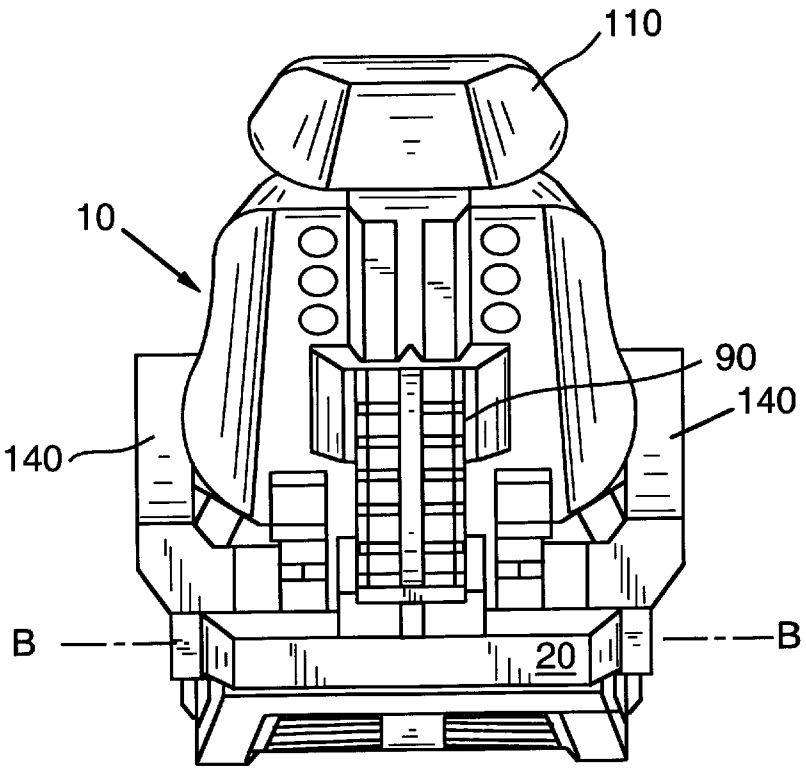
FIG. 10 is a rear view of the chair of FIGS. 8 and 9.
Figure 9:
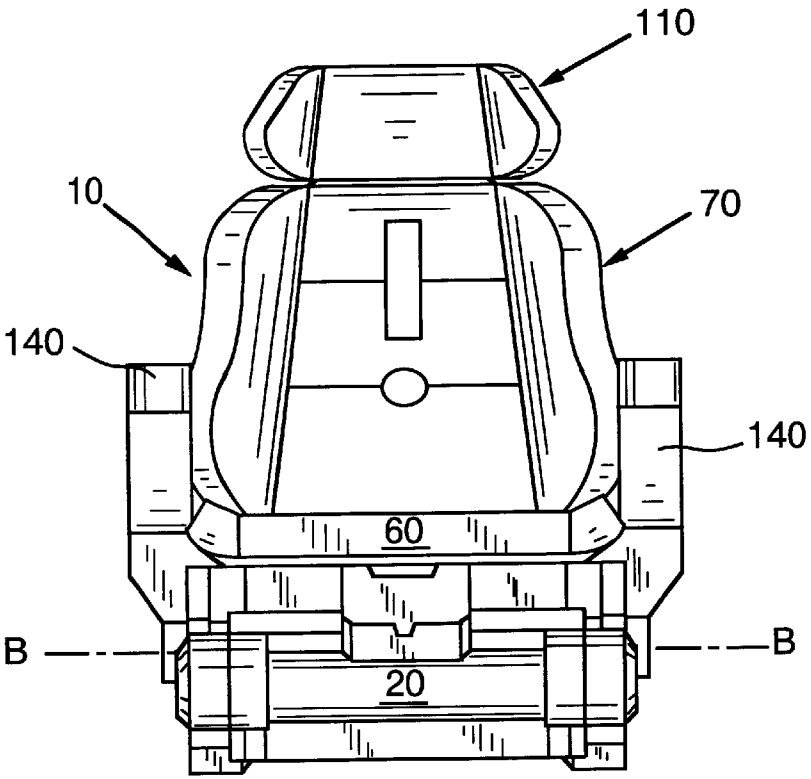
FIG. 9 is a front view of the chair of FIG. 8.
Figure 11:
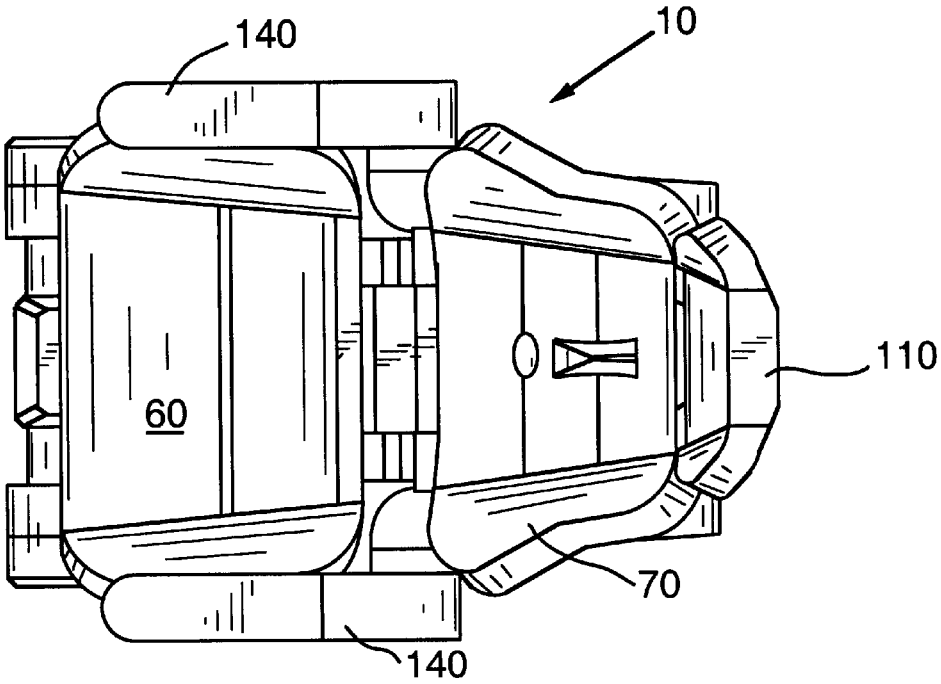
FIG. 11 is a top view of the chair of FIGS. 8-10.
Figure 12:
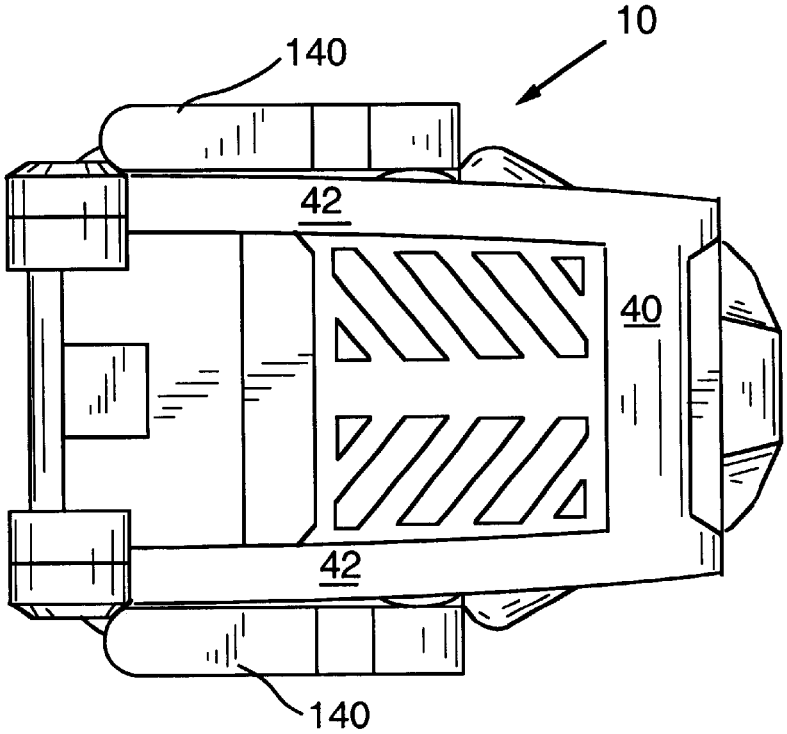
FIG. 12 is a bottom view of the chair of FIGS. 8-11.
Figure 13:
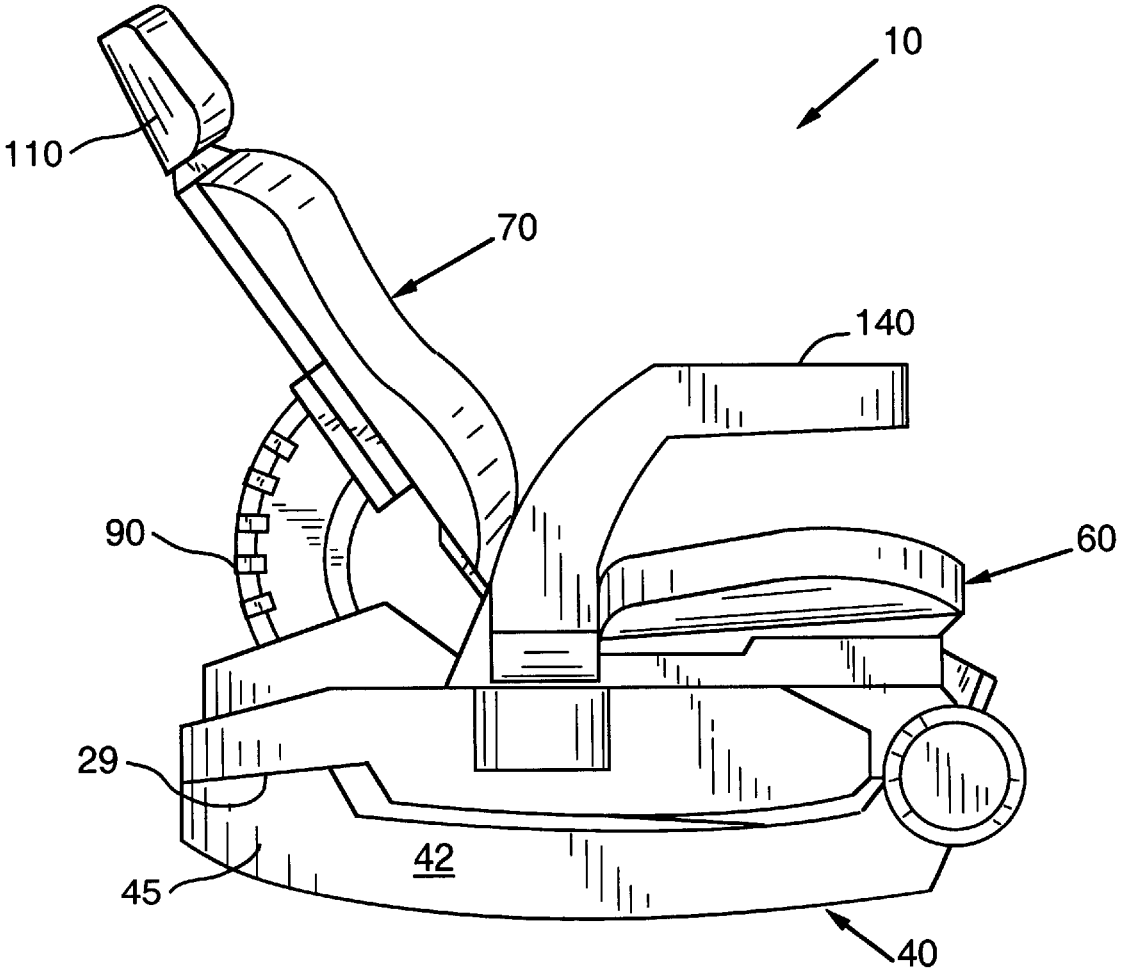
FIG. 13 is a right side elevation view of the chair of FIGS. 1–12.

Referring now to the drawings for the purposes of illustrating the present preferred embodiments of the invention only and not for the purposes of limiting the same, FIG. 1 depicts a chair 10 constructed according to one embodiment of the present invention. The reader will appreciate that the chair 10 of the present invention is well-suited for use when playing video games and the like. However, those of ordinary skill in the art will readily appreciate that the unique and novel aspects of the present invention provide advantages which may be enjoyed in a variety of different applications. Thus, the present invention should not be limited to video game applications.

As can be seen in FIGS. 1–13, the chair 10 comprises a base 20, a footrest 40, a seat 60, a seatback 70, a headrest 110 and arm rests 140. In this embodiment, the aforementioned components are fabricated from a polymeric material utilizing known rotational molding manufacturing techniques and process. However, the skilled artisan will appreciate that these components may be fabricated from a myriad of other materials without departing from the spirit and scope of the present invention.

FIGS. 14–17, depict a base 20 of the present invention.

As can be seen in those Figures, the base 20 has a bottom surface 22, a top surface 24 and two lateral sides 26. To facilitate storage of, for example, video game cassettes, compact discs, controller apparatus, etc. within the chair 10, a storage well 28 is formed in the base 20. See FIGS. 14 and 15. The base 20 is also provided with an upstanding attachment portion 30 for pivotally affixing the seat 60 and the seatback 70 thereto in the manners described below. In addition, base 20 is provided with an opening 32 that extends therethrough for receiving a seatback support member 90 for supporting the seatback 70 in various reclining positions relative to the base 20 as will be discussed in further detail below.

Figure 17:
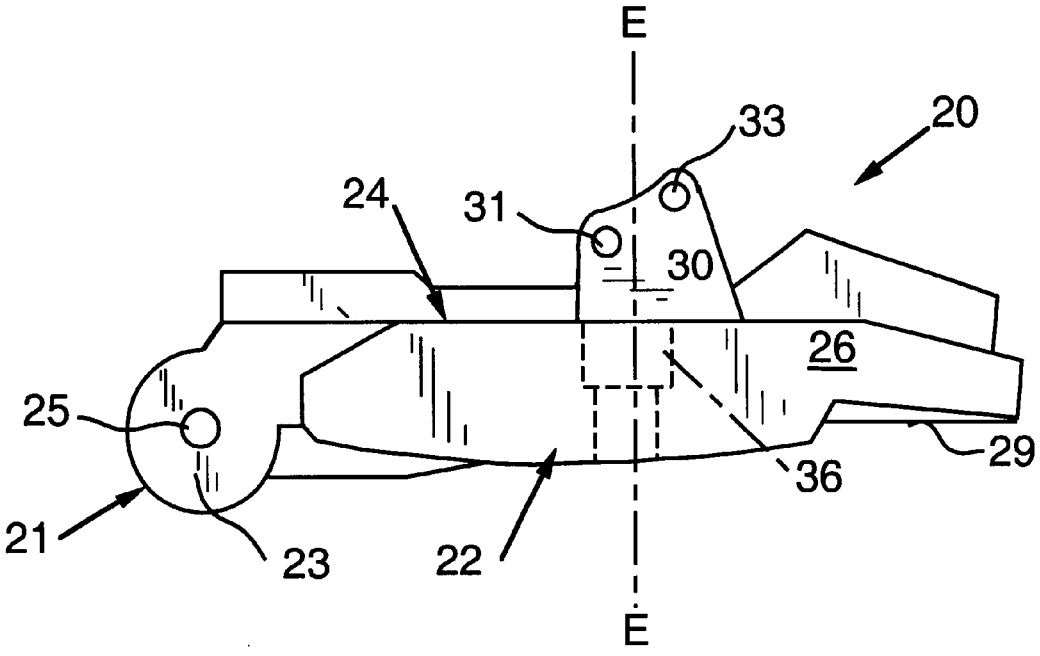
FIG. 17 is a side elevational view of the base of FIGS. 14–16.
Figure 18:
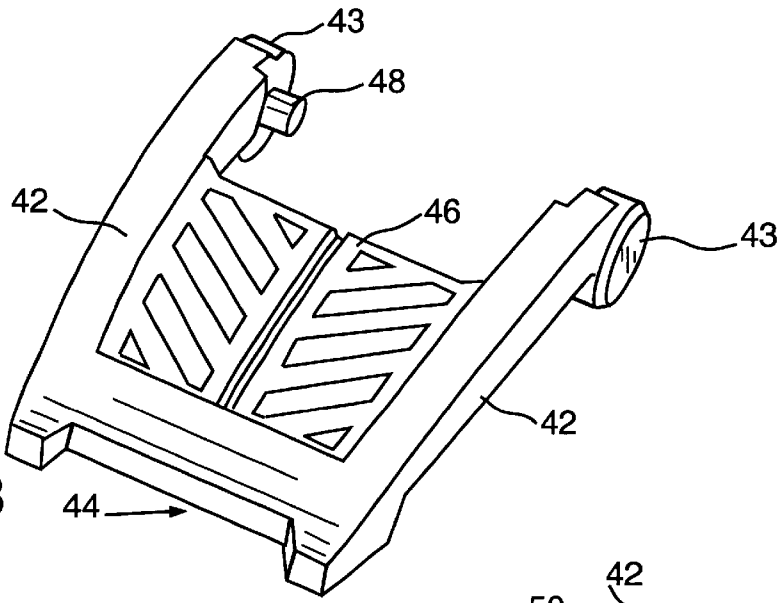
FIG. 18 is a perspective view of a footrest of the present invention.
Figure 19:
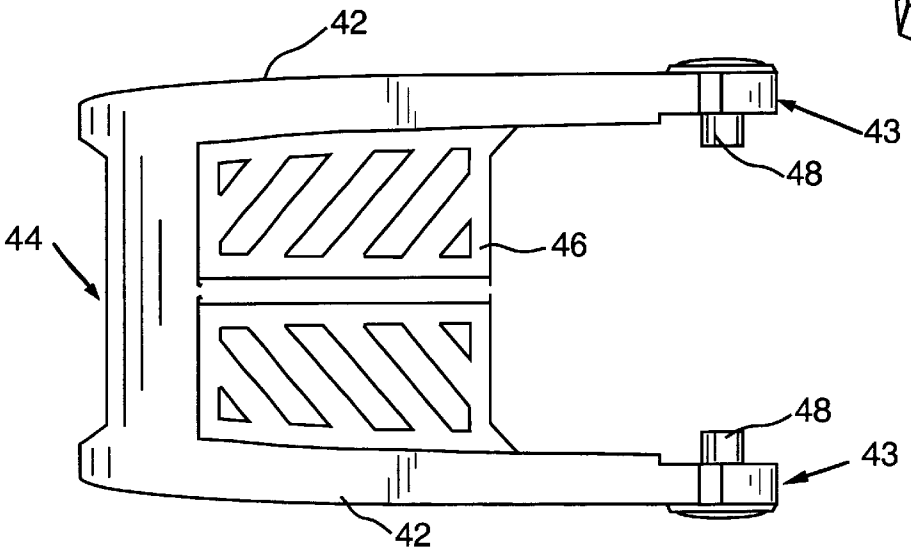
FIG. 19 is a top view of the footrest of FIG. 18.
Figure 20:
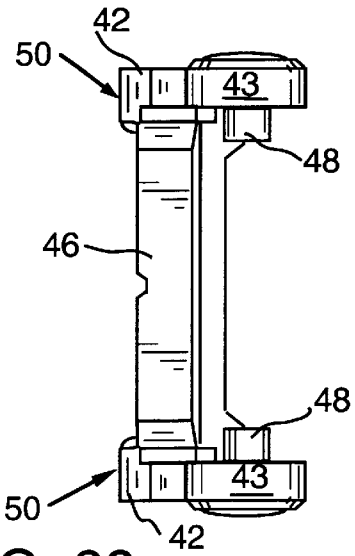
FIG. 20 is an end view of the footrest of FIGS. 18 and 19.

A footrest 40 of the present invention is depicted in FIGS. 18–20. The footrest 40 is preferably configured as shown in those Figures and has two arcuately shaped rocker rail portions 42, a front portion 44, and a tread plate portion 46 that extends between the side rails 42. To facilitate pivotal attachment of the footrest 40 to a front portion 21 of the base 20, a pair of bosses 23 are formed in the front portion 21 of the base 20. See FIGS. 14–17. An attachment hole 25 is provided through each boss 23 in the base 20. Holes 25 are coaxially aligned along a first pivot axis "B—B" that is substantially transverse to the longitudinal axis "A—A" of the base 20. Turning again to FIGS. 18–20, it can be seen that the rear end 43 of each side portion 42 of the footrest 40 is provided with an inwardly protruding axle member 48 that is adapted to be rotatably received in a corresponding hole 25 in a corresponding boss 23 to facilitate pivotal travel of the footrest 40 relative to the base 20 about axis B—B. See FIG. 7. Those of ordinary skill in the art will appreciate that when the base 20 and or footrest axles 48 are fabricated from a flexible polymeric material, the axles 48 may be snapped into their corresponding holes 25 in the bosses 23.

In this embodiment, each side portion 42 of the footrest 40 has an arcuately shaped upper surface 50 that functions as a rocker surface when the footrest 40 is pivoted to a first position under the base 20. See FIGS. 12 and 13. To facilitate somewhat better rocking support on a planar surface, the tread plate portion 46 is slightly recessed below the arcuate surfaces 50 such that when the footrest 40 is in the first position, the tread plate portion 46 does not contact the surface on which the chair 10 is supported. See FIG. 20. The lower surface 52 of the footrest 40 is complementary-shaped relative to the bottom surface 22 of the base 20. To support the front portion 44 of the footrest 40 when the footrest 40 is pivoted to an extended position (FIGS. 1–6), the front portion 44 of the footrest 40 has a downwardly extending stabilizer portion 45 formed thereon. Thus, when the footrest 40 is in the first position, the stabilizer portion 45 is received in a corresponding recessed portion 29 provided in the bottom surface 22 of the base 20. See FIGS. 8–13. When in that position, the base 20 is supported on the arcuate side portions 42 of the footrest 40 enabling the chair 10 to function as a rocking chair. When the footrest 40 is pivoted to the extended position, it serves as a support for the user's legs and feet.

Figure 21:
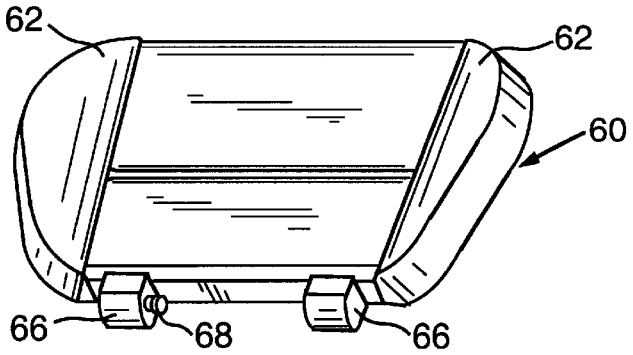
FIG. 21 is a perspective view of a seat of the present invention.
Figure 22:
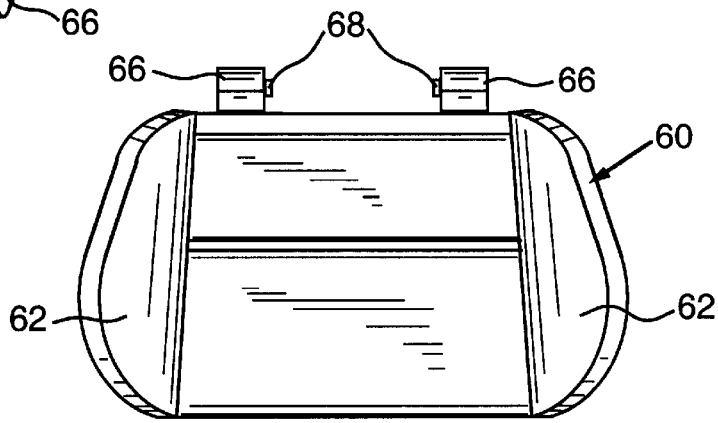
FIG. 22 is a front view of the seat of FIG. 21.
Figure 23:
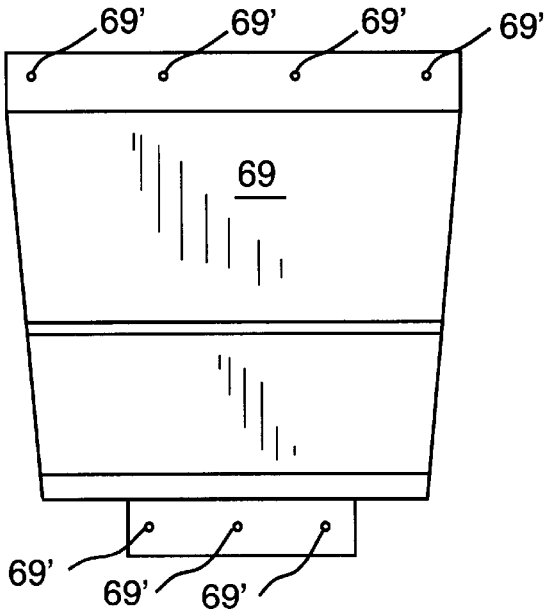
FIG. 23 is a top view of a seat pad of the present invention.
Figure 26:
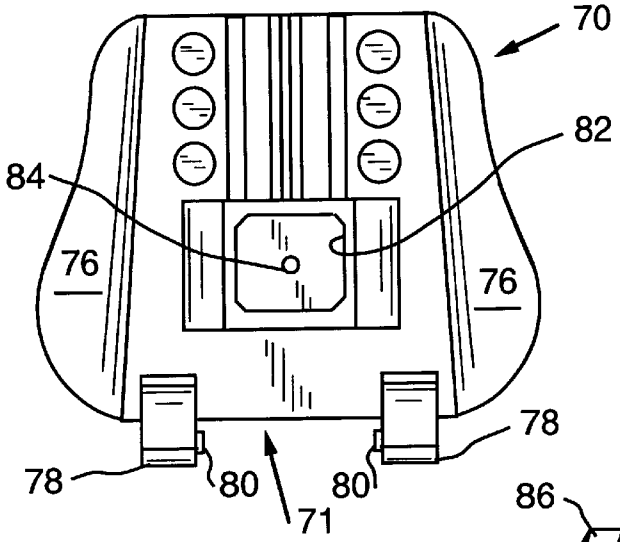
FIG. 26 is a rear view of the seatback of FIGS. 24 and 25.
Figure 27:
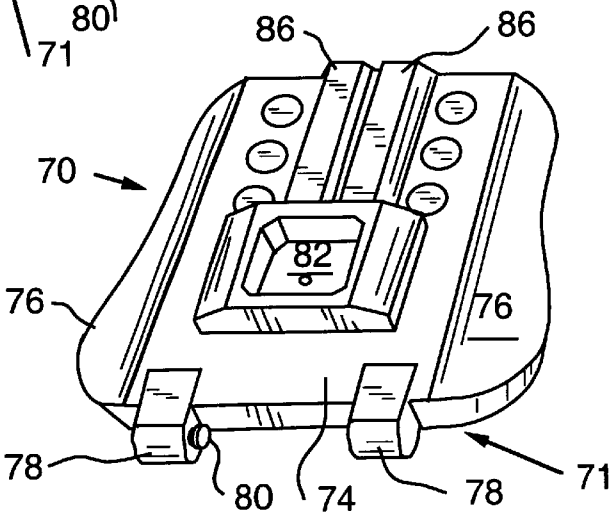
FIG. 27 is a rear perspective view of the seatback of FIGS. 24–26.
Figure 25:
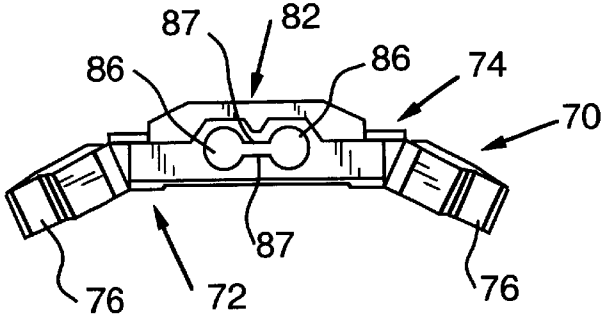
FIG. 25 is a top view of the seatback of FIG. 24.
Figure 24:
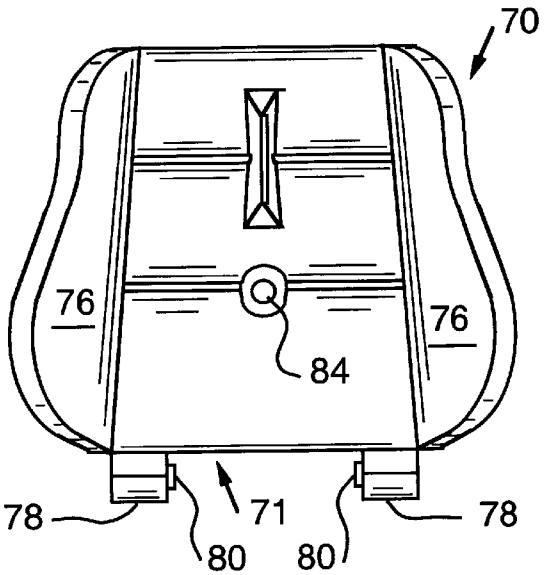
FIG. 24 is a front view of a seatback of the present invention.

FIGS. 21 and 22 depict a seat 60 of the present invention. As can be particularly seen in those Figures, the seat 60 may be provided with flaring side portions 62 to enhance comfort of the occupant. To facilitate pivotal attachment of the seat 60 to the base 20, a pair of bosses 66 are formed on the rear end 64 of the seat 60. Each boss 66 has an inwardly protruding axle 68 that is adapted to be rotatably received in corresponding holes 31 in the attachment member 30. Holes 31 are coaxially aligned in the attachment member 30 along a second pivot axis "C—C" that is substantially transverse to the longitudinal axis A—A of the base 20. See FIG. 14. Thus, when the axles 68 are snapped into their corresponding holes 31 in the attachment member 30 of the base 20, the seat 60 is selectively pivotable about the second pivot axis C—C. Those of ordinary skill in the art will appreciate that when the seat 60 is pivoted in a first position it overlies the storage well 28 in the base 20 to define a storage area 35 within the base 20 (shown in dotted lines in FIG. 7). The seat 60 may then be pivoted to an open position wherein the storage well 28 is exposed to facilitate removal of items stored therein. To provide the user with additional comfort, a seat pad 69, configured as shown in FIG. 23, may be attached to the seat 60 by, for example, commercially available push fasteners (not shown) that extend through holes 69' in seat pad 69 and are snapped into receiving holes (not shown) in the seat 60. The seatback 69 may comprise a collection of cloth (i.e., nylon fabric, cloth fabric, etc.)—covered foam (i.e., polyurethane foam pads. However, other seat pad arrangements could be successfully used.

FIGS. 24–27 depict a seatback 70 of the present invention. As can be seen in those Figures, the seatback 70 has a front side 72, a rear side 74 and flared side portions 76 for enhancing comfort of the occupant. A pair of bosses 78 are formed on the lower portion 71 of the seatback 70 as shown in Figures. An axle 80 protrudes from each boss 78 and is adapted to be rotatably received in corresponding holes 33 provided in the attachment portion 30 of the base 20. Holes 33 are coaxially aligned along a third axis "D—D" that is substantially transverse to the longitudinal axis "A—A" of the base 20 such that when the axles 80 are received on their corresponding holes 33, the seatback 70 may be selectively pivoted relative to the base 20 about axis "D—D".

Figure 30:
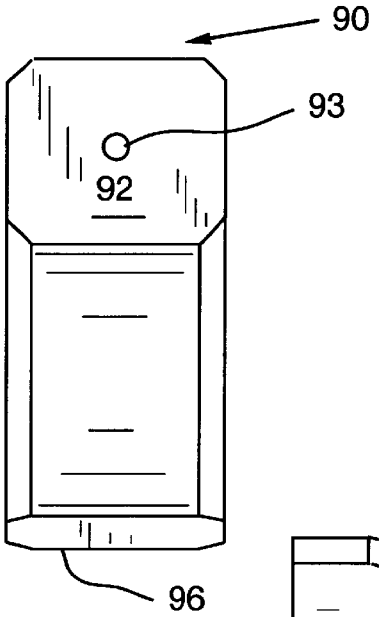
FIG. 30 is a front view of the seatback support member of FIG. 29.

To support the seatback 70 in any one of a plurality of reclined positions, the seatback 70 is attached to an arcuate support member 90. More particularly and with reference to FIGS. 25–27, a socket 82 is formed in the rear surface 74 of the seatback 70 for receiving an end 92 of the support member 90 therein. The end 92 of the support member 90 is attached to the seatback 70 by a screw (not shown) that extends through a hole 84 in the seatback 70 and into a threaded hole 93 in the end of the support member 90. See FIG. 30.

Figure 28:
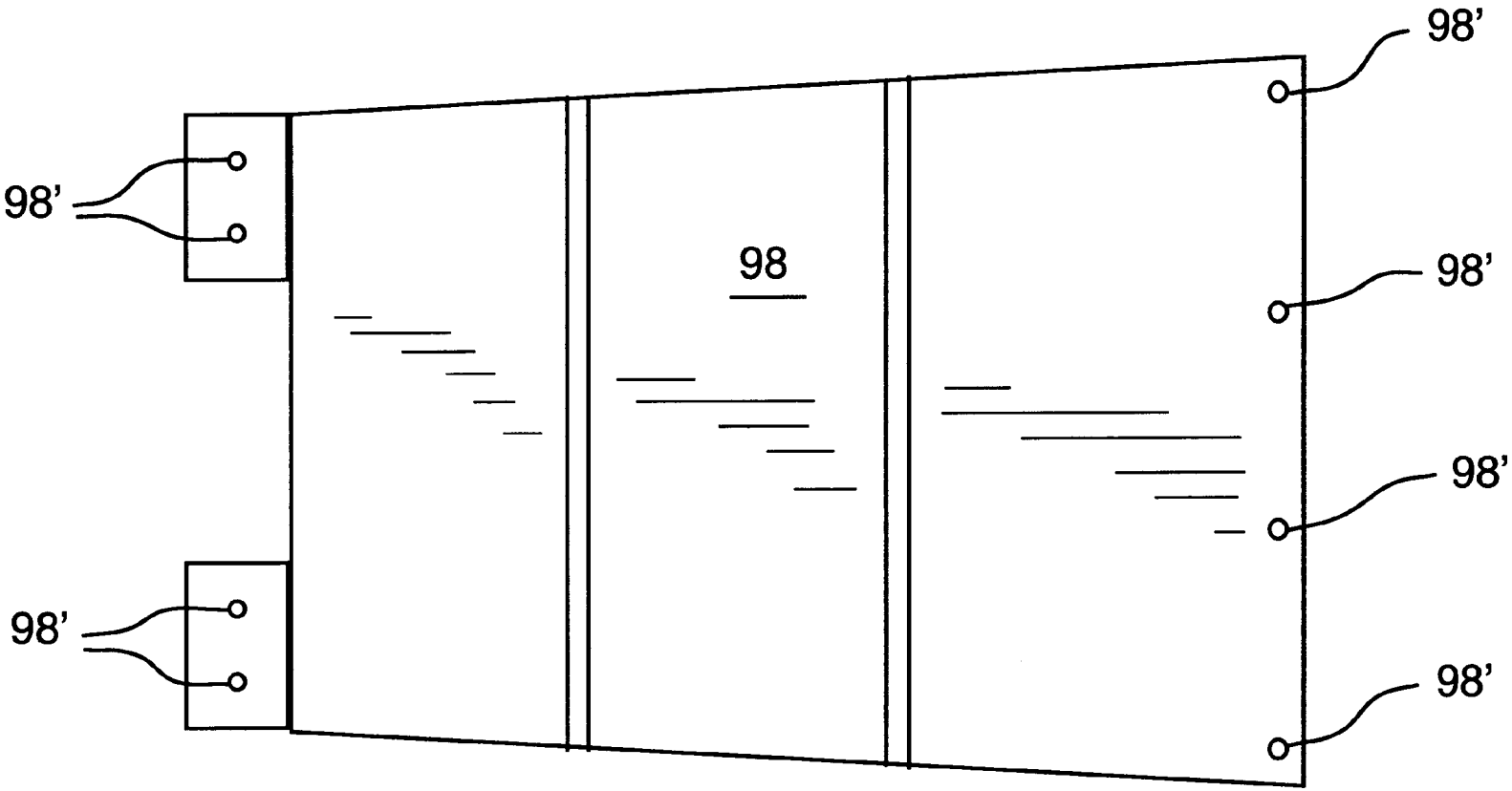
FIG. 28 is a top view of a seatback pad of the present invention.
Figure 29:
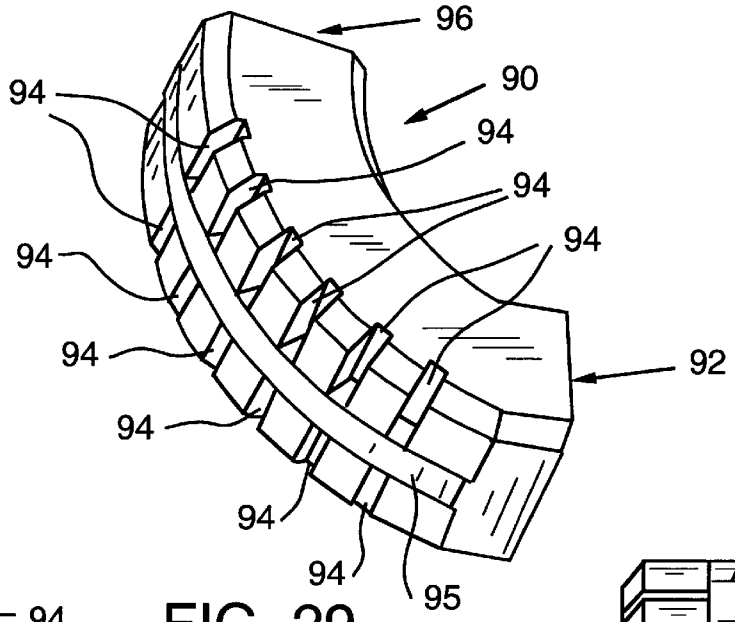
FIG. 29 is a perspective view of a seatback support member of the present invention.
Figure 32:
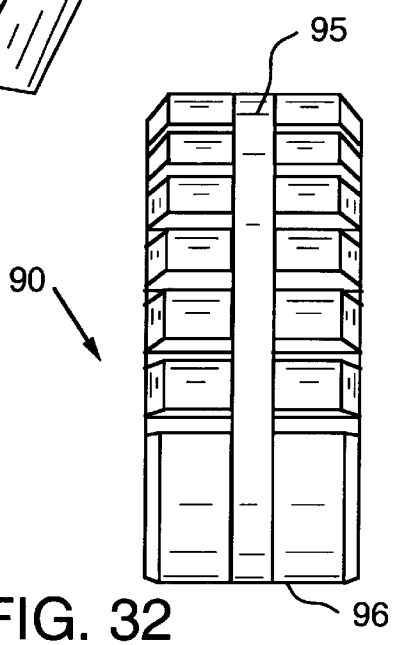
FIG. 32 is a rear view of the seatback support member of FIGS. 27–29.
Figure 31:
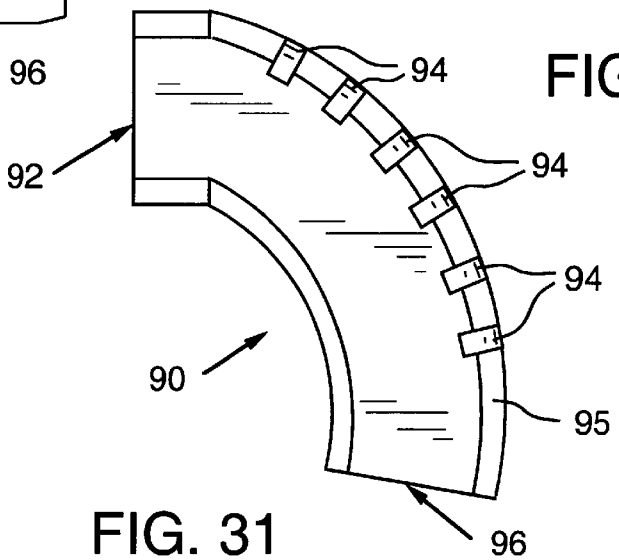
FIG. 31 is a side view of the seatback support member of FIGS. 29 and 30.
Figure 33:
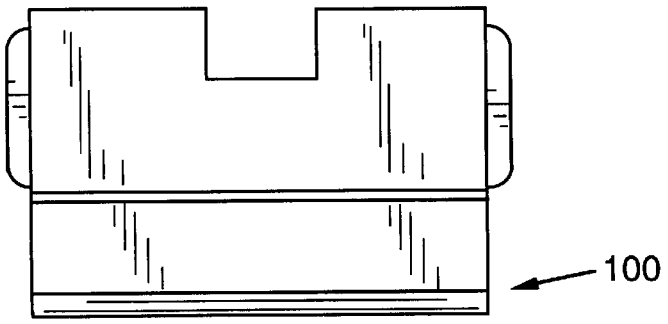
FIG. 33 is a top view of a seatback engagement tab of the present invention.
Figure 34:
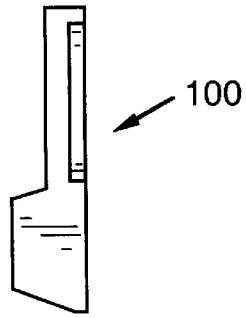
FIG. 34 is a side view of the seatback engagement tab of FIG. 33.
Figure 35:
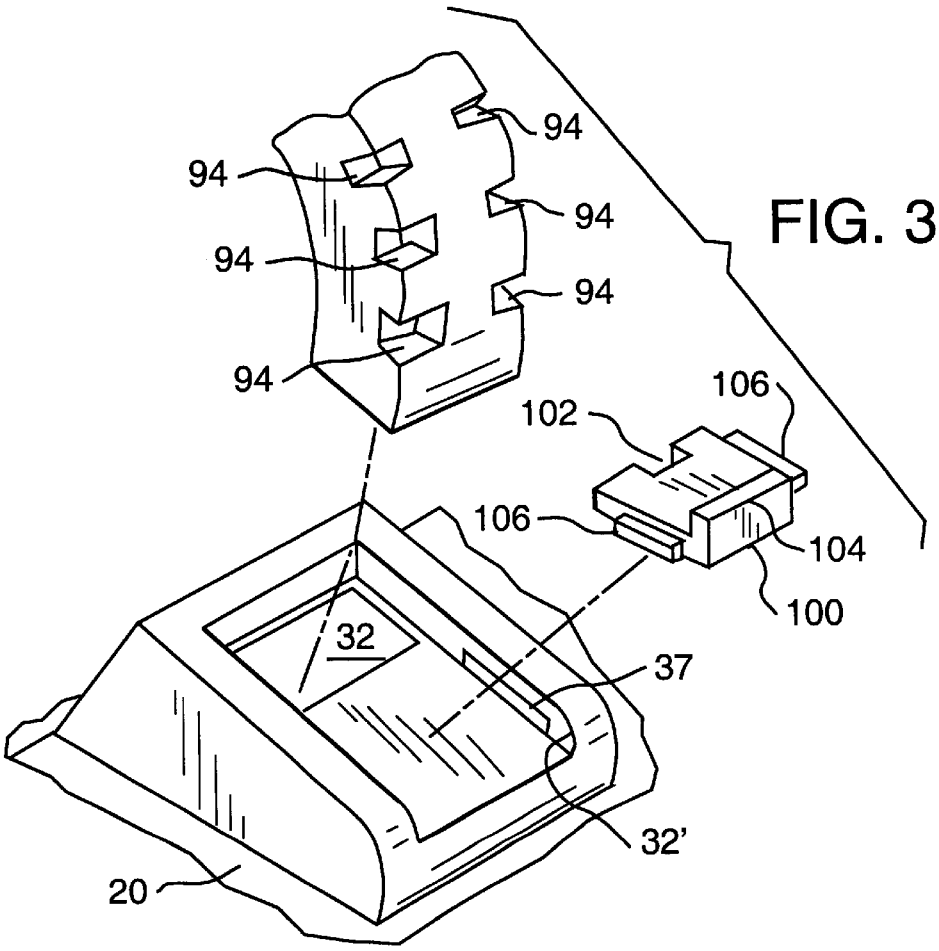
FIG. 35 is a partial exploded assembly view of a retainer member arrangement of the present invention for retaining the seatback in a desired position.
Figure 35A:
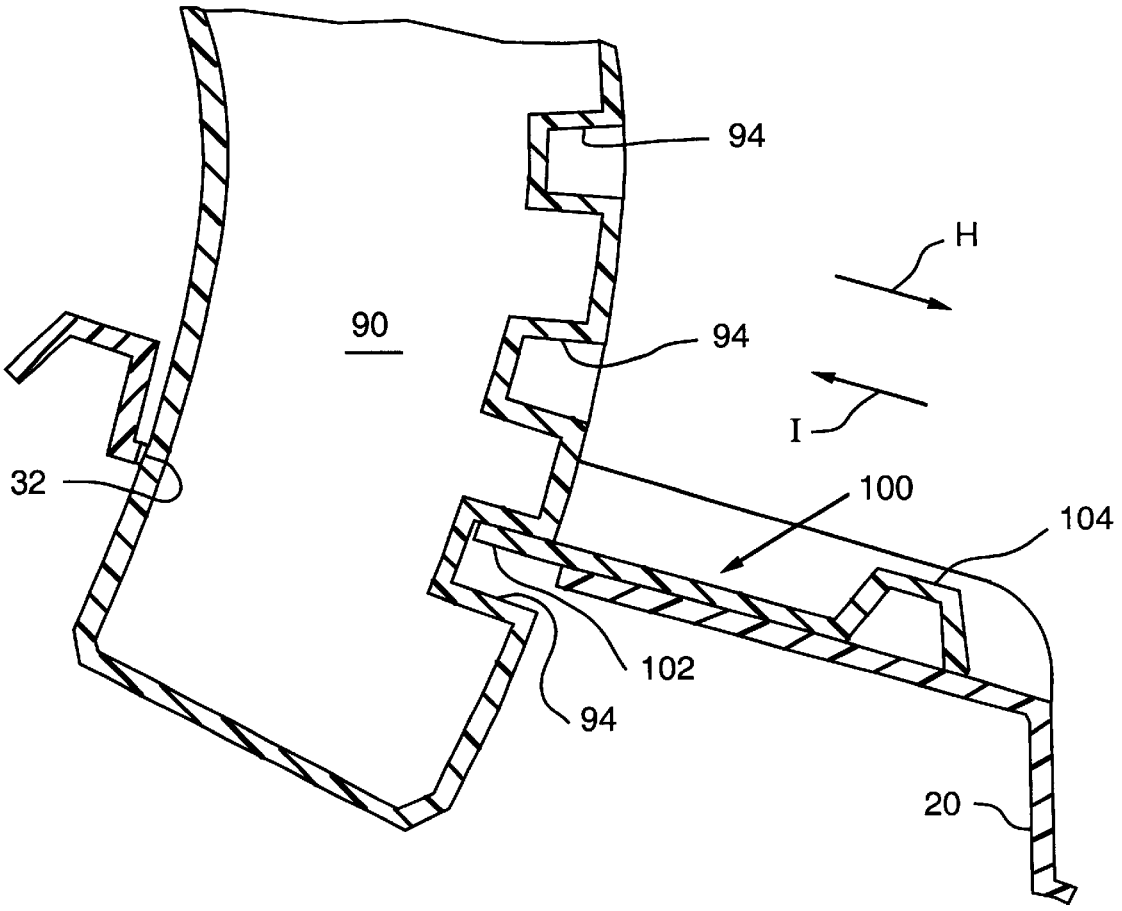
FIG. 35A is a partial cutaway side view of the base and support member of the present invention showing the retainer member engaging a slot in the seatback support member.
Figure 35B:
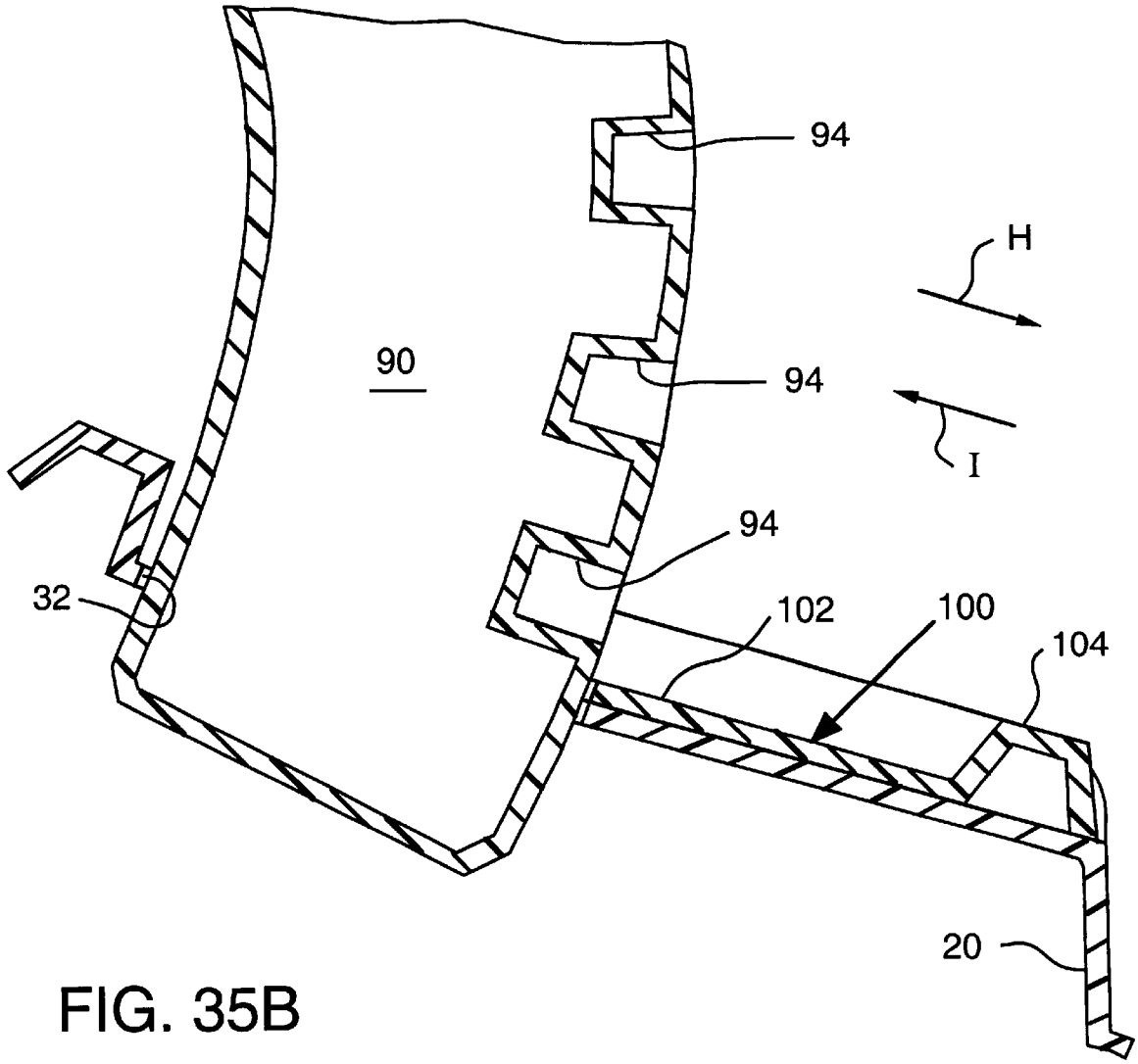
FIG. 35B is a partial cutaway side view of the base and support member of the present invention showing the retainer member in a disengaged position.

The support member 90 is arcuately shaped and has a plurality of retaining recesses 94 formed on each side of a central rib 95. The other end 96 of the support member 90 is movably received in an opening 32 provided in the base 20. To selectively engage slots 94 in the support member 90, a retaining member 100 is slidably supported in the base 20 as shown in Figure. More specifically and with reference to FIGS. 33, 34, 35, 35A, and 35B, retaining member 100 comprises a slotted end portion 102 adapted to selectively engage corresponding retaining slots 94 in the support member 90 and a raised handle portion 104. See FIGS. 33 and 34. Retaining member 100 is sized to be slidably received in a recessed portion 32' in the base for selective slidable travel therein (represented by arrows "H" and "I" in FIGS. 35A and 35B). Retaining member is slidably retained in the recess 32' by lateral retaining tabs 106 that are slidably received in corresponding grooves 37 in base 20. See, FIG. 35. Thus, to adjust the position of the seatback 70 relative to the seat 60, the user grasps the handle portion 104 of the retaining member and slides it in the "H" direction to permit the support member 90 to be moved into or out of the opening 32 in the base. After the desired seatback position is achieved, the retaining member 100 is slidably moved in the "I" direction to bring the engagement portion 104 of the retaining member 100 into engagement with the slots 94 in the support member 90. Those of ordinary skill in the art will readily appreciate that such arrangement permits the seatback 70 to be selectively retained in anyone of a plurality of reclined positions defined, for example, by the location and number of slots 94 in the support member 90. Also, if so desired, a seatback pad 98, configured as shown in FIG. 28, may be attached to the seatback 70 by, for example, commercially available push fasteners (not shown) that extend through holes 98' in the seatback pad 98 and are snapped into corresponding holes (not shown) provided in the seatback 70. See FIG. 28.

Figure 39:
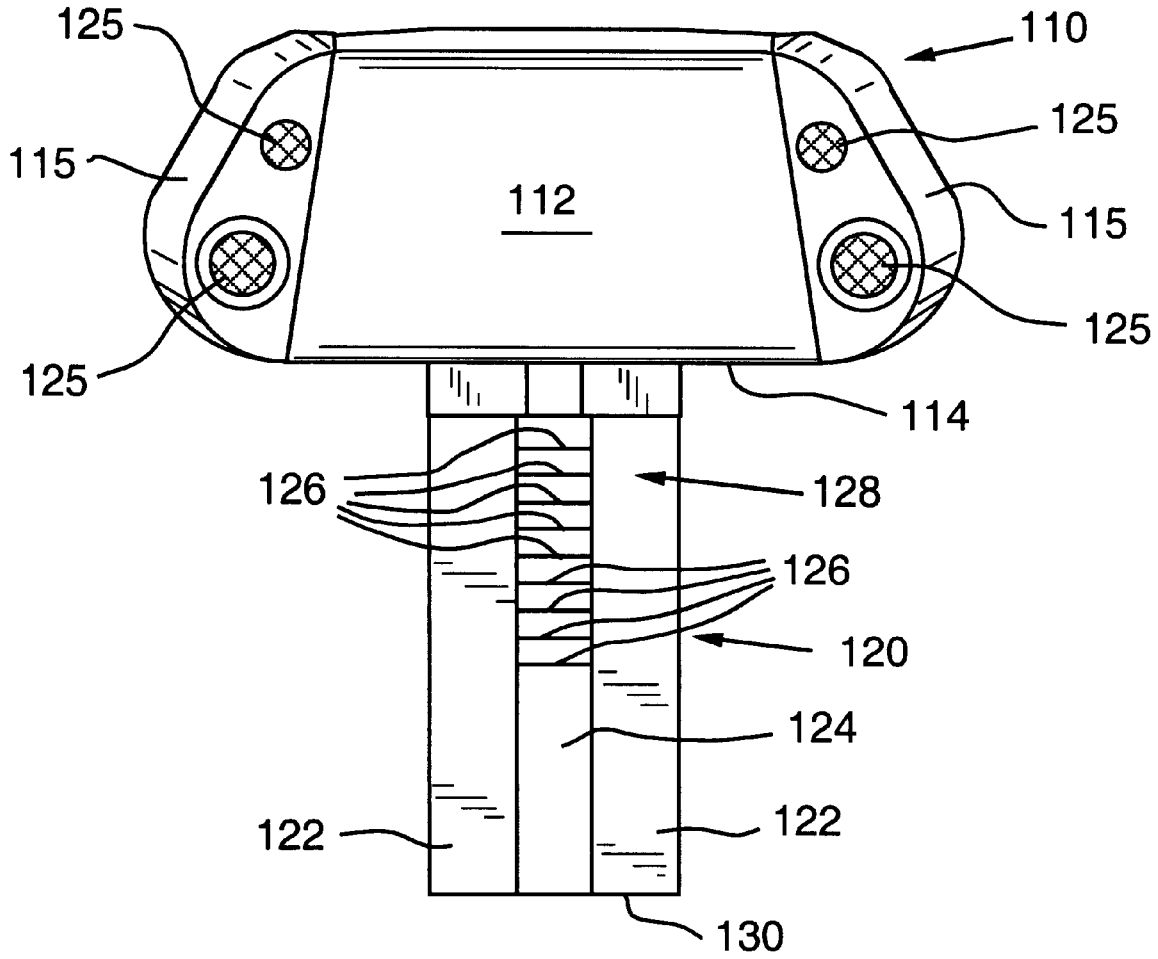
FIG. 39 is a front assembly view of the attachment post assembly attached to the head support panel of the present invention.
Figure 36:
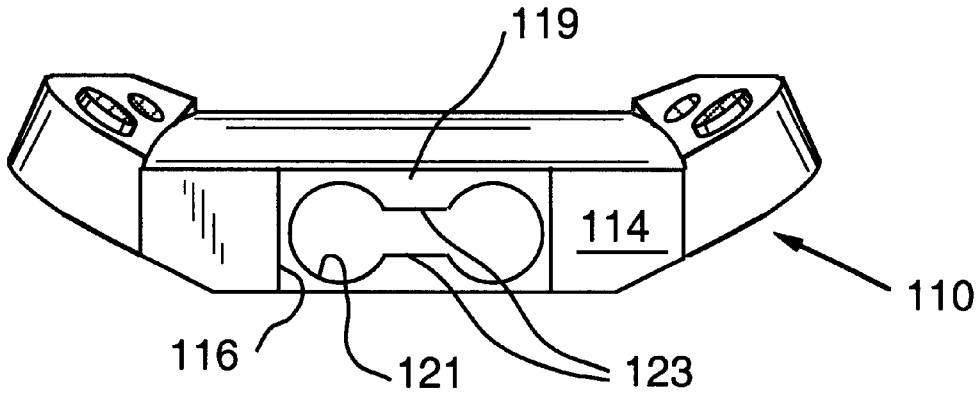
FIG. 36 is a bottom view of a head support panel of the present invention.

Also in this embodiment, the seatback 70 is provided with an adjustable headrest 110 as shown in FIGS. 36 and 39. As can be seen in those Figures, the headrest 110 comprises a head support panel 112 and an attachment post assembly 120. The head support member 112 may be advantageously provide with flaring sides 115 to enhance the comfort of the occupant. As can be seen in FIG. 39, commercially available speakers 125 may be installed in the side portions 115 of the head support portion 112. Those of ordinary skill in the art will appreciate that the speakers 125 may be connected to appropriate sound generating devices such as, for example, stereos, compact disc players, television sets, etc. to further enhance the occupant's comfort and enjoyment.

As noted above, the head support portion 112 is adjustably attached to head support portion by an attachment post assembly 120. Attachment post assembly 120 comprises two semi-circular shaped posts 122 that are interconnected by a central rib portion 124 that extends therebetween. The posts 122 and central rib portion 124 are integrally molded together and a plurality of slots 126 are preferably molded in to the central attachment portion 124 as shown in FIG. 39.

Figure 37:
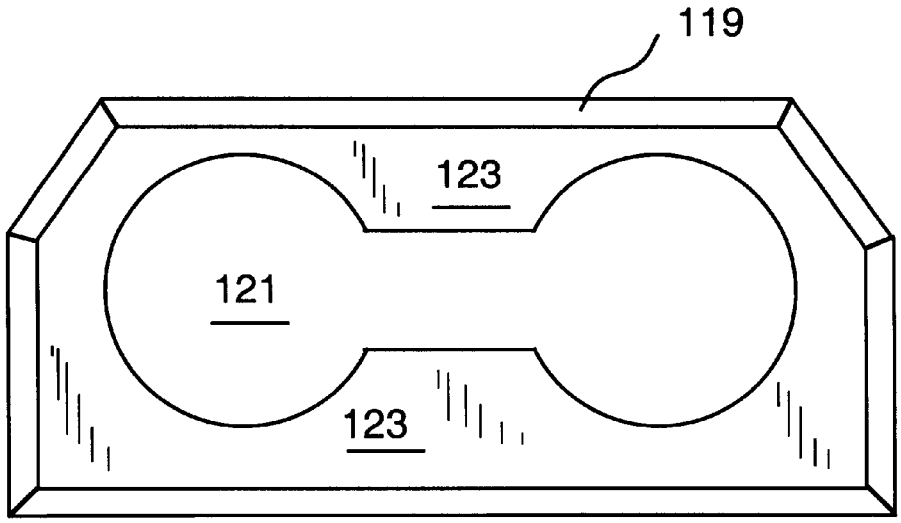
FIG. 37 is top view of a headrest support panel attachment tab of the present invention.
Figure 38:
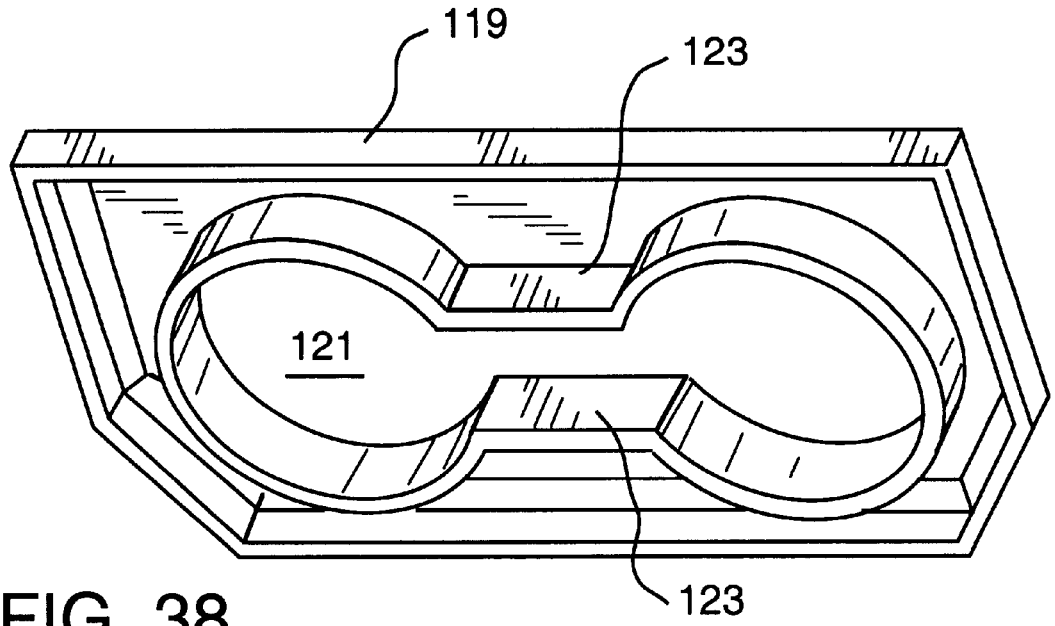
FIG. 38 is a bottom perspective view of the attachment tab of FIG. 37.

An end 128 of the attachment post assembly 120 is adapted to be received within a socket provided in the support panel 112. In this embodiment, the support panel 112 is substantially hollow and a recess 116 is provided in the bottom surface 114 of the support panel 112. The recess 116 defines an opening through the bottom 114 of the support panel 112 such that the attachment post assembly 120 may extend therethrough into the hollow center of the support panel 112. Received within the recess 116 is a tab member 119 that has an opening 121 therethrough that corresponds to the shape of the attachment post assembly 120. See FIGS. 36–38. The tab 117 is sized relative to the recess 116 such that it is retained within the recess by an interference fit. As can be seen in FIGS. 37 and 38, the tab member 119 has two opposing engagement tabs 123 adapted to engage the slots 126 in the central support portion 124 of the attachment post assembly 120. Thus, the end 128 of the attachment post assembly is inserted into the opening 121 in the tab 119 and is movably affixed thereto by virtue of engagement between the tabs 123 and a corresponding slot 126. Another end 130 of the attachment post assembly 120 is slidably received in correspondingly shaped sockets 86 formed in the seatback 70. Engagement tabs 87 are provided between the sockets 86 to engage the retaining slots 126 in the central portion 124 of the attachment post assembly 120. See FIG. 25. Thus, the position of the support panel 112 relative to the top of the seatback 70 can be selectively adjusted by sliding the support panel 112 on the attachment post assembly 120 and/or sliding the attachment post assembly 120 into or out of the sockets 86 in the seatback 70 until the desired position is attained. The support panel 112 is retained in that position by virtue of engagement between tabs 123 and the slots 126 and tab 87 and slots 126.

Figure 40:
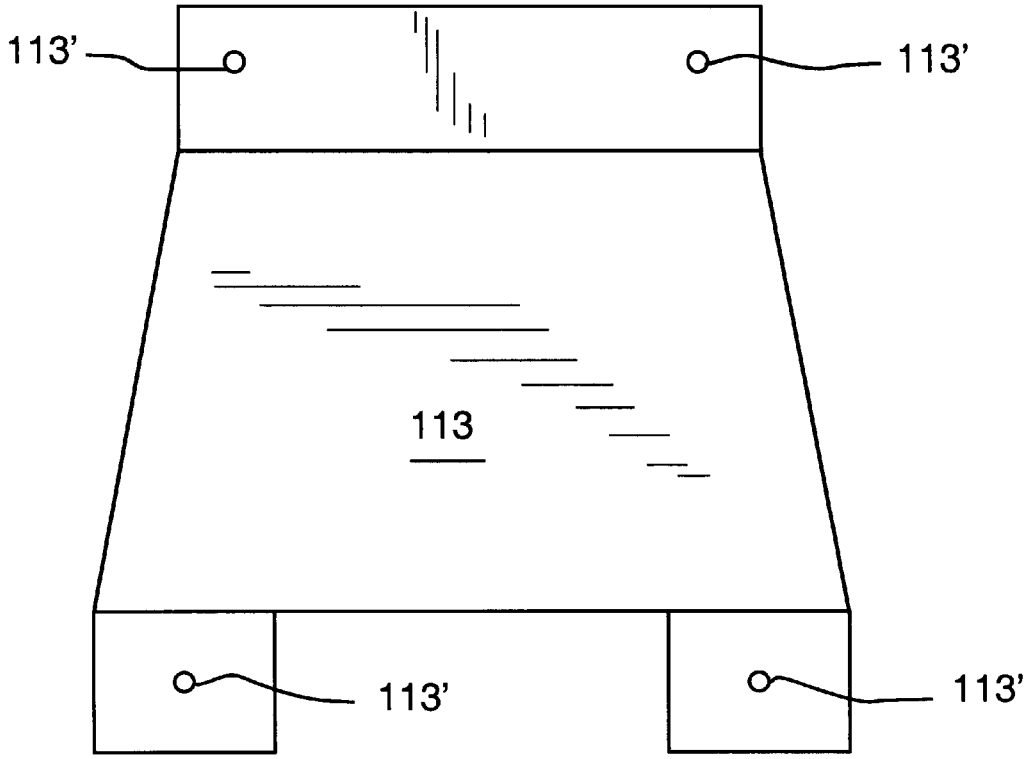
FIG. 40 is a top view of a headrest support pad of the present invention.

Also in this embodiment, the head support portion 112 may be provided with a support pad 113, that is configured as shown in FIG. 40. Support pad 113 is attached to the head support portion 112 by, for example, commercially available push fasteners (not shown) that extend through holes 113' in the pad 113 and are snapped into corresponding holes (not shown) in the head support portion 113. Support pad 113 may comprise cloth (i.e., cloth, nylon fabric, etc.)—covered foam (i.e., polyurethane foam) pads. However, other support pad arrangements could be successfully used.

Figure 14:
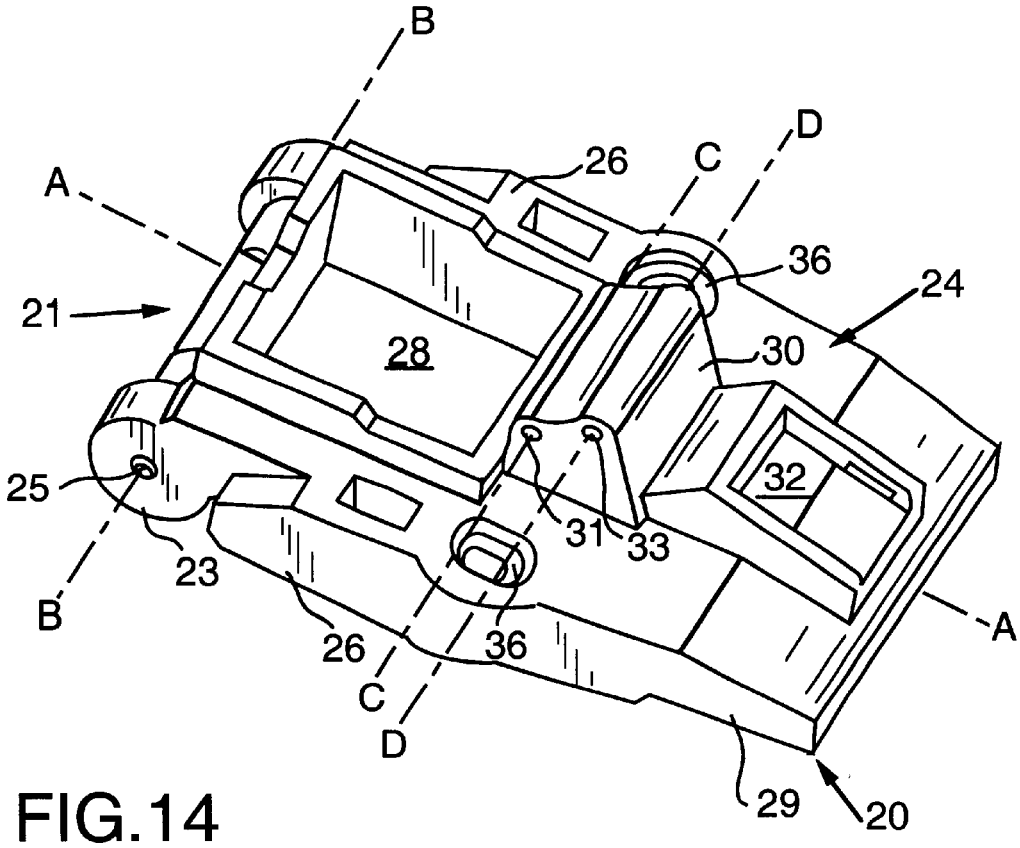
FIG. 14 is a perspective view of the base of the chair of the present invention.
Figure 15:
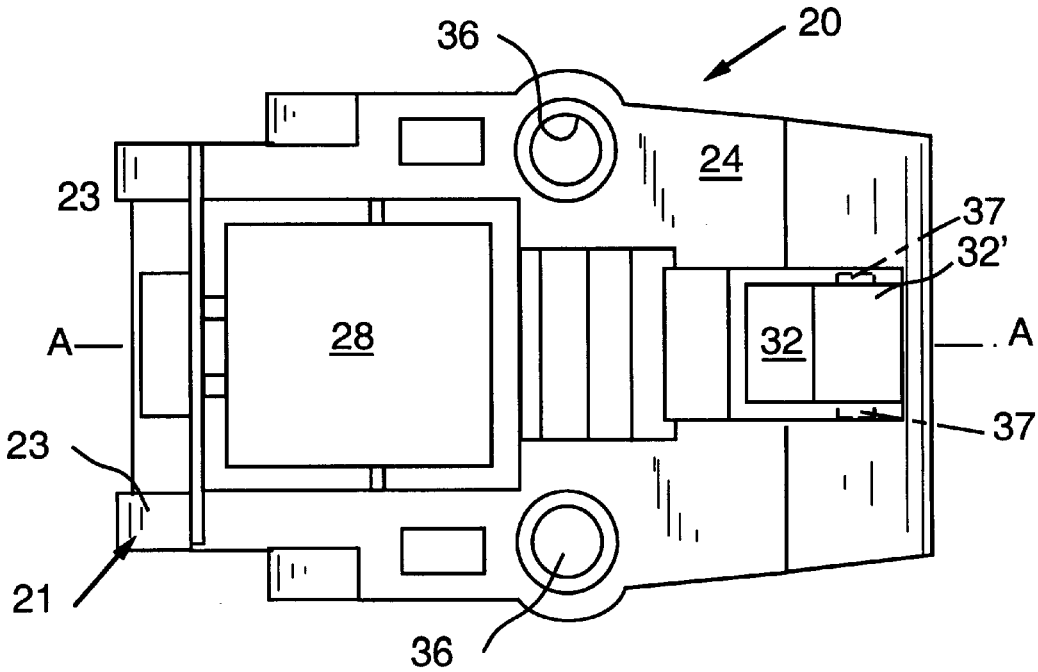
FIG. 15 is a top view of the base of FIG. 14.
Figure 16:
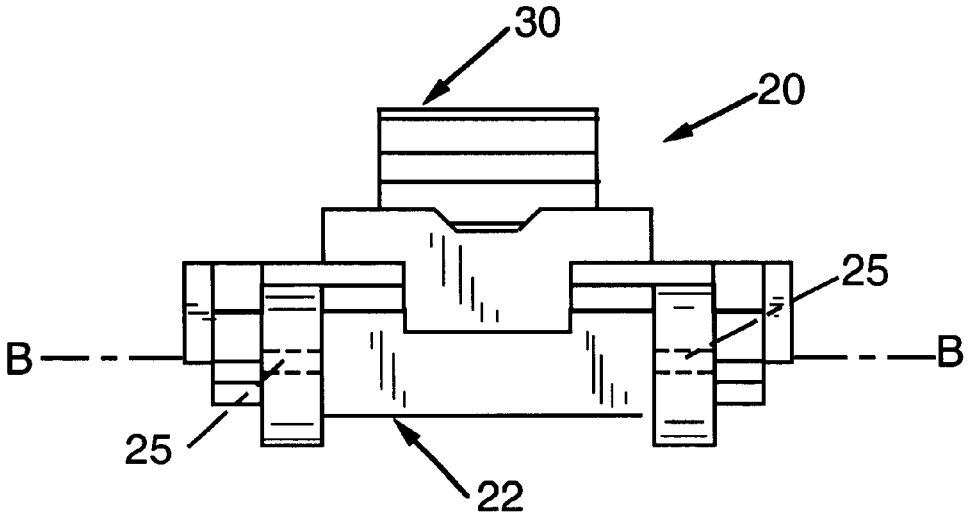
FIG. 16 is a front view of the base of FIGS. 14 and 15.
Figure 41:
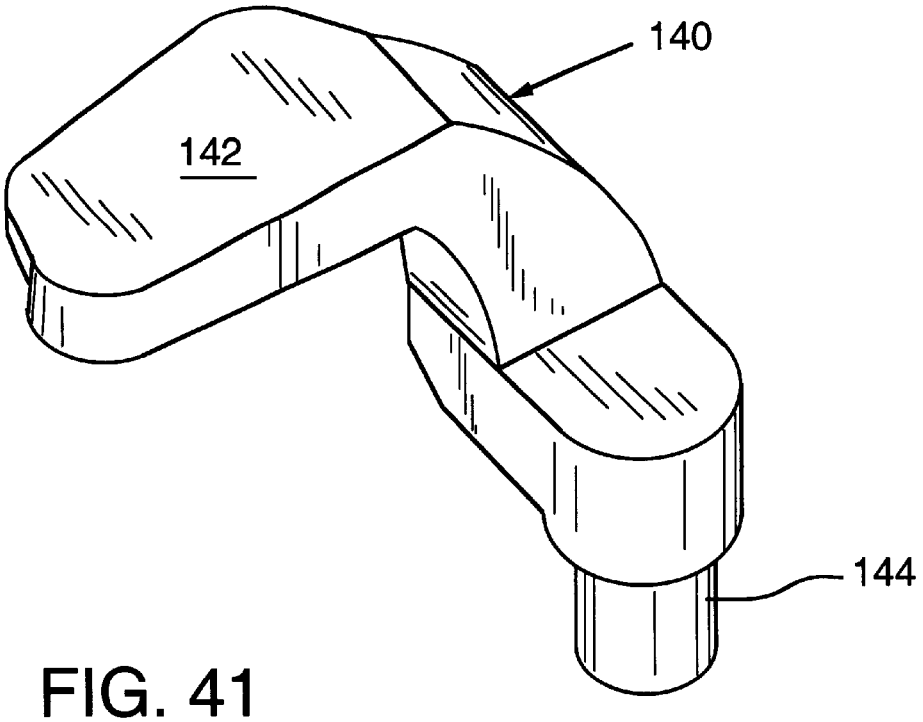
FIG. 41 is a perspective view of an arm rest of the present invention.

The subject invention may also be provided with a pair of arm rests 140 that are removably detachable to the base 20 and that may be selectively rotatable about a corresponding pivot axis. As can be seen in FIGS. 14, 15, and 17, the base 20 is provided with two sockets 36. Each socket 36 defines a vertically extending pivot axis "E—E" that is substantially vertically transverse to the longitudinal axis "A—A" of the base 20. Each arm rest 140 has an arm support portion 142 and a round attachment post 144 integrally formed with the arm support portion 142. See FIG. 41. Each attachment post 144 is sized relative to its corresponding socket 36 to create a sliding friction fit therebetween when the post 144 is inserted therein. Those of ordinary skill in the art will appreciate that such arrangement enables the arm rest 140 to be selectively rotated about its corresponding pivot axis "E—E" to thereby enable the arm rests 140 to be pivoted away from the seat 60 to provide sufficient clearance to enable the seat 60 to be opened and closed.

Thus, from the foregoing discussion, it is apparent that the present invention represents a vast improvement over prior chairs and, in particular, over those chairs that are suited for use in connection with playing video games and the like. The chair of the present invention offers a comfortable seat that can be adjusted to suit the relative size and comfort requirements of the user. The subject invention can also enhance the video game playing experience, by providing a chair that can be rocked on a surface or statically supported on the surface. The subject chair also provides a unique storage well for storing various articles such as, for example, video game cartridges, cassettes, controllers, etc. , when not in use. Further, the present invention is safe, attractive, and comfortable. Those of ordinary skill in the art will, of course, appreciate that various changes in the details, materials, and arrangement of parts which have been herein described and illustrated in order to explain the nature of the invention may be made by the skilled artisan within the principal and scope of the invention as expressed in the appended claims.

What is claimed is:

1. A chair, comprising:

a seat the base;

a seatback attached to said seat; and a foot rest pivotally attached to said seat and pivotable between a first position wherein said foot rest forms a rocker surface under said base and a second extended position relative to said seat.

2. The chair of claim 1 wherein said seat is pivotally attached to a base that has a storage area therein.

3. The chair of claim 1 wherein said seatback is pivotally attached to a base and wherein said chair further comprises an adjustable seatback support member extending between said seatback and said base.

4. The chair of claim 1 wherein said seat and said seatback are attached to a base and wherein said chair further comprises at least one arm rest removably supportable on said base.

5. The chair of claim 4 wherein at least one said arm rest can be selectively rotated relative to said base.

6. The chair of claim 1 further comprising a headrest adjustably affixed to said seatback.

7. A chair, comprising:

a base member;

a seat attached to said base member;

a seatback attached to said base member; and a footrest pivotably attached to said base member and selectively pivotable between a first folded position wherein said footrest forms a rocker base and a second extended position relative to said seat.

8. The chair of claim 7 wherein said footrest has at least one arcuate rocker rail on one side and a stabilizer portion on another side.

9. The chair of claim 8 wherein said rocker rails and said stabilizer portion are each integrally formed with said footrest.

10. The chair of claim 8 wherein a tread pattern is formed in said another side of said footrest.

11. The chair of claim 7 wherein said base has a storage well formed therein and wherein said seat is pivotally attached to said base such that said seat may be selectively pivotable between a first position wherein said seat substantially overlays said storage well to define a storage area within said base and a second position wherein said storage well is exposed.

12. The chair of claim 11 further comprising a seat pad attached to said seat.

13. The chair of claim 7 further comprising a pair of arm rests removably attached to said base.

14. The chair of claim 13 wherein each said arm rest is selectively pivotable about a corresponding pivot axis that extends vertically relative to said base.

15. The chair of claim 14 wherein each said arm rest comprises an arm support and a vertical post protruding from said arm support, each said vertical post sized to be rotatably received in a corresponding socket formed in said base.

16. The chair of claim 7 wherein said seatback is pivotally attached to said base.

17. The chair of claim 16 further comprising a seatback support member attached to a rear surface of said seat back and adapted to selectively engage said base in a plurality of positions for supporting said seatback in any one of a plurality of non-parallel orientations relative to said seat.

18. The chair of claim 17 wherein said seatback support member comprises an arcuate brace having a plurality of slots therein that define said plurality of non-parallel orientations, said slots selectively engagable with a locking tab attached to said base.

19. The chair of claim 18 wherein said locking tab is slidably affixed to said base for selective slidable travel between a first position wherein said locking tab engages at least one said slot in said arcuate brace and a second position wherein said locking tab does not engage any of said slots in said arcuate brace.

20. The chair of claim 16 further comprising a seatback pad attached to said seatback.

21. The chair of claim 7 further comprising a headrest adjustably affixed to said seatback.

22. The chair of claim 21 wherein said headrest comprises:

an attachment post assembly affixed to said seatback; and a head support panel having a socket therein for slidably receiving a portion of said attachment post therein.

23. The chair of claim 22 wherein said attachment post assembly has a plurality of engagement recesses formed therein which define headrest positions and wherein said head support panel has at least one engagement tab formed adjacent said socket for selectively engaging said engagement recesses in said attachment post assembly.

24. The chair of claim 22 wherein said attachment post assembly comprises a pair of semi-circular shaped post members and a connection member integrally formed with and extending between said semi-circular shaped post members, said connection member having a plurality of recesses formed therein for engaging a corresponding tab formed on said head support.

25. The chair of claim 24 wherein said socket in said head support panel is shaped to receive said pair of circular-shaped post members and said connection member therein, said head support having opposing tabs formed therein and extending into said socket to selectively engage said recesses in said connection member.

26. The chair of claim 21 further comprising a head rest pad attached to said head support member.

27. The chair of claim 22 wherein said seatback has a seatback socket formed therein for slidably receiving a portion of said attachment post assembly therein.

28. The chair of claim 27 wherein said attachment post assembly has a plurality of engagement recesses formed therein which define headrest positions and wherein said seatback has at least one engagement tab formed therein for engaging a corresponding said recess when said attachment post assembly is received in said seatback socket.

29. The chair of claim 23 wherein said seatback has a seatback socket formed therein for slidably receiving a portion of said attachment post assembly therein.

30. The chair of claim 29 wherein said seatback has at least one seatback engagement tab formed therein for engaging a corresponding said recess when said attachment post assembly is received in said seatback socket.

31. A chair, comprising:

a base having a storage well formed therein;

a seat pivotally attached to said base such that said seat may be selectively pivoted between a closed position wherein said seat overlays said storage well to define a storage area in said base and at least one open position wherein said storage well is exposed;

a seatback pivotally attached to said base and selectively supportable in a plurality of non-planar positions relative to said seat;

an adjustable headrest attached to said seatback;

at least one arm rest removably attached to said base and being selectively pivotable relative to said base; and a footrest pivotally attached to said base and selectively pivotable between a first position wherein said base is supported on said footrest and a second position wherein said footrest is extended relative to said base.

32. The chair of claim 31 further comprising:

at least one arcuate surface on said footrest such that when said footrest is in said first position, said base can rock on said arcuate surface; and a stabilzer portion on said foot rest for supporting a portion of said foot rest on a surface when said footrest is in the second position.

33. The chair of claim 31 wherein each said arm rest comprises an arm support and a vertical post protruding from said arm support, each said vertical post sized to be rotatably received in a corresponding socket formed in said base.

34. The chair of claim 31 wherein said seatback is supportable relative to said base by an arcuate brace having a plurality of slots therein that define said plurality of non-planar positions, said slots selectively engagable with a locking tab attached to said base.

35. The chair of claim 34 wherein said locking tab is slidably affixed to said base for selective slidable travel between a first position wherein said locking tab engages at least one said slot in said arcuate brace and a second position wherein said locking tab does not engage any of said slots in said arcuate brace.

36. The chair of claim 31 wherein said headrest comprises:

an attachment post affixed to said seatback; and a head support panel having a socket therein for slidably receiving said attachment post therein.

37. The chair of claim 36 wherein said post has a plurality of engagement recesses formed therein which define headrest positions and wherein said head support panel has at least one engagement tab formed adjacent said socket for selectively engaging said engagement recesses said post.

38. The chair of claim 36 wherein said attachment post comprises a pair of circular-shaped post members and a connection member integrally formed with and extending between said circular-shaped post members, said connection member having a plurality of recesses formed therein for engaging a corresponding tab formed on said head support panel.

39. The chair of claim 38 wherein said socket in said head rest is shaped to receive said pair of circular-shaped post members and said connection member therein, said head support having opposing tabs formed therein and extending into said socket to selectively engage said recesses in said connection member.

40. The chair of claim 31 further comprising:

a seat pad member attached to said seat;

a backrest pad attached to said seatback; and a headrest pad attached to headrest.

41. The chair of claim 31 wherein said base, said seat, said seatback, said headrest, said footrest and said arm rests are each fabricated from a blow-molded polymeric material.

42. The chair of claim 36 further comprising at least one speaker in said head support panel.

43. A chair, comprising:

a seat pivotably attached to a base that has a storage area therein;

a seatback attached to said seat; and a foot rest pivotally attached to said seat and pivotable between a first position wherein said foot rest forms a rocker surface under said base and a second extended position relative to said seat.

44. A chair, comprising:

a seat;

a seatback attached to said seat, wherein said seatback is pivotally attached to a base and wherein said chair further comprises an adjustable seatback support member extending between said seatback and said base; and a foot rest pivotally attached to said seat and pivotable between a first position wherein said foot rest forms a rocker surface under said base and a second extended position relative to said seat.

45. A chair, comprising:

a seat;

a seatback attached to said seat, wherein said seat and said seatback are attached to a base;

at least one arm rest removably supportable on said base; and a foot rest pivotally attached to said seat and pivotable between a first position wherein said foot rest forms a rocker surface under said base and a second extended position relative to said seat.

46. The chair of claim 45, wherein at least one said arm rest can be selectively rotated relative to said base.

47. A chair, comprising:

a seat; a base;

a seatback attached to said seat;

a headrest adjustably affixed to said seatback; and a foot rest pivotally attached to said seat and pivotable between a first position wherein said foot rest forms a rocker surface under said base and a second extended position relative to said seat.

* * * * *

UNITED STATES PATENT AND TRADEMARK OFFICE

CERTIFICATE OF CORRECTION

PATENT NO. : 6,283,546 B1
DATED : September 4, 2001
INVENTOR(S) : Hill

It is certified that error appears in the above-identified patent and that said Letters Patent is hereby corrected as shown below:

Title page,
Item [56], References Cited, U.S. PATENT DOCUMENTS, please insert
-- 4,883,317 * 11/1989 Davenport 297/188.1 --.

Signed and Sealed this

Thirtieth Day of December, 2003

JAMES E. ROGAN
*Director of the United States Patent and Trademark Office*